US009080807B2

(12) United States Patent
Cho et al.

(10) Patent No.: US 9,080,807 B2
(45) Date of Patent: Jul. 14, 2015

(54) COOLING APPARATUS AND REFRIGERATOR HAVING THE SAME

(75) Inventors: Yeonwoo Cho, Seoul (KR); Yanggyu Kim, Seoul (KR); Younseok Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 363 days.

(21) Appl. No.: 13/182,298

(22) Filed: Jul. 13, 2011

(65) Prior Publication Data

US 2012/0011883 A1 Jan. 19, 2012

Related U.S. Application Data

(60) Provisional application No. 61/415,519, filed on Nov. 19, 2010.

(30) Foreign Application Priority Data

| | | |
|---|---|---|
| Jul. 13, 2010 | (KR) | 10-2010-0067196 |
| Jul. 15, 2010 | (KR) | 10-2010-0068244 |
| Jul. 15, 2010 | (KR) | 10-2010-0068461 |
| Jul. 15, 2010 | (KR) | 10-2010-0068466 |
| Jul. 19, 2010 | (KR) | 10-2010-0069287 |
| Jul. 19, 2010 | (KR) | 10-2010-0069358 |

(51) Int. Cl.
*F25D 17/04* (2006.01)
*F25D 17/06* (2006.01)
*F25D 21/00* (2006.01)

(52) U.S. Cl.
CPC ..... *F25D 17/062* (2013.01); *F25D 21/006* (2013.01); *F25D 2317/061* (2013.01); (Continued)

(58) Field of Classification Search
CPC ..... F25D 17/067; F25D 2317/0671; F25D 2317/0672; F25D 2400/28; F25D 2400/30; F25D 25/025; F25D 11/02; F25D 17/06; F25D 31/00; F25D 17/04; F25D 17/065
USPC ..... 62/408, 426, 419, 440, 62, 441
See application file for complete search history.

(56) References Cited

U.S. PATENT DOCUMENTS 2,000,021 A * 5/1935 Hoffman et al. ..... 366/256
2,020,638 A * 11/1935 Feltault ..... 366/332
(Continued)

FOREIGN PATENT DOCUMENTS

CN 1384321 A 12/2002
CN 1605820 A 4/2005
(Continued)

OTHER PUBLICATIONS

PCT International Search Report dated Apr. 4, 2012 for Application No. PCT/KR2011/005150, 4 pages.
(Continued)

*Primary Examiner* — Frantz Jules
*Assistant Examiner* — Martha Tadesse
(74) *Attorney, Agent, or Firm* — Fish & Richardson P.C.

(57) ABSTRACT

Provided are a cooling apparatus and a refrigerator having the same. The cooling apparatus includes a case that receives a container holding a liquid and that includes an inlet and an outlet, and at least one fan that promotes movement of air into the case through the inlet, over the container holding the liquid, and out of the case through the outlet. The cooling apparatus also includes a drawer with an agitating member that agitates the container holding the liquid during cooling. The drawer is removable from the case and replaceable in the case. The cooling apparatus further includes a power generator that includes a portion fixed to the case and generates a driving force that causes the agitating member to agitate the container holding the liquid.

10 Claims, 18 Drawing Sheets

(52) U.S. Cl.
CPC ... *F25D2317/0666* (2013.01); *F25D 2331/803* (2013.01); *F25D 2331/805* (2013.01); *F25D 2400/28* (2013.01); *F25D 2400/30* (2013.01); *F25D 2400/361* (2013.01)

(56) References Cited

U.S. PATENT DOCUMENTS

| | | | | | |
|---|---|---|---|---|---|
| 3,797,272 | A | * | 3/1974 | Huey | 62/381 |
| 5,207,762 | A | * | 5/1993 | Newman | 62/419 |
| 5,228,499 | A | * | 7/1993 | Yoon | 165/263 |
| 5,317,883 | A | * | 6/1994 | Newman | 62/419 |
| 6,003,734 | A | * | 12/1999 | Oh | 222/146.6 |
| 6,865,899 | B2 | * | 3/2005 | Nam et al. | 62/187 |
| 7,017,354 | B2 | | 3/2006 | Lee | |
| 7,059,142 | B2 | * | 6/2006 | Jeong et al. | 62/186 |
| 7,343,748 | B2 | * | 3/2008 | Freesmeier et al. | 62/62 |
| 8,091,376 | B2 | * | 1/2012 | Bianchi et al. | 62/291 |
| 2005/0072166 | A1 | | 4/2005 | Lee | |
| 2007/0151284 | A1 | * | 7/2007 | Freesmeier et al. | 62/419 |
| 2008/0134695 | A1 | * | 6/2008 | Loibl et al. | 62/64 |
| 2009/0139247 | A1 | * | 6/2009 | Pimputkar et al. | 62/62 |
| 2012/0011884 | A1 | * | 1/2012 | Cho et al. | 62/419 |
| 2012/0011885 | A1 | * | 1/2012 | Cho et al. | 62/426 |

FOREIGN PATENT DOCUMENTS

| | | | | |
|---|---|---|---|---|
| CN | 1752695 | A | | 3/2006 |
| EP | 1 522 805 | A1 | | 4/2005 |
| JP | 2003-262448 | A | | 9/2003 |
| JP | 2006-200786 | | * | 3/2006 |
| JP | 2006-200786 | A | | 8/2006 |
| KR | 20-2000-0000951 | A | | 1/2000 |
| KR | 10-2000-0009208 | A | | 2/2000 |
| KR | 10-2002-0027724 | A | | 4/2002 |
| KR | 2005-041036 | | * | 3/2005 |
| KR | 10-2005-0041036 | | * | 5/2005 |
| KR | 10-2005-0041036 | A | | 5/2005 |

OTHER PUBLICATIONS

PCT International Search Report dated Apr. 4, 2012 for Application No. PCT/KR2011/005155, 4 pages.
PCT International Search Report dated Apr. 4, 2012 for Application No. PCT/KR2011/005158, 4 pages.
PCT International Search Report dated Apr. 4, 2012 for Application No. PCT/KR2011/005160, 4 pages.
PCT International Search Report dated Apr. 4, 2012 for Application No. PCT/KR2011/005162, 4 pages.
Chinese Search Report dated May 7, 2014 for CN Application No. 2011800343415, wirth English Translation, 4 Pages.

* cited by examiner

COOLING APPARATUS AND REFRIGERATOR HAVING THE SAME

CROSS REFERENCES TO RELATED APPLICATIONS

The present application claims the benefit of priority to Korean Patent Application Nos. 10-2010-0067196 (filed on Jul. 13, 2010), 10-2010-0068244 (filed on Jul. 15, 2010), 10-2010-0068461 (filed on Jul. 15, 2010), 10-2010-0068466 (filed on Jul. 15, 2010), 10-2010-0069358 (filed on Jul. 19, 2010), and 10-2010-0069287 (filed on Jul. 19, 2010), which are herein incorporated by reference in their entirety.

The present application also claims the benefit of U.S. Provisional Application No. 61/415,519, filed on Nov. 19, 2010, which is herein incorporated by reference in its entirety.

FIELD

The present disclosure relates to a cooling apparatus that cools content, such as foods or beverages, and a refrigerator having the same.

BACKGROUND

The consumer's needs for a cooling apparatus that can quickly cool beverages such as drinks or beers which exist at room temperature are being increased. For this, cooling apparatus having various shapes and types are proposed.

SUMMARY

In one aspect, a refrigerator includes a refrigerator body, and a refrigerating compartment and a freezing compartment being configured to maintain operating temperatures that differ, with the freezing compartment having an operating temperature that is lower than an operating temperature of the refrigerating compartment. The refrigerator also includes a cooling apparatus that is positioned in the refrigerating compartment and that is configured to cool liquid held by a container positioned in the cooling apparatus to a refrigerated temperature faster than the refrigerating compartment. The cooling apparatus includes a case that is configured to receive the container holding the liquid and that includes an inlet and an outlet, and at least one fan configured to promote movement of air into the case through the inlet, over the container holding the liquid, and out of the case through the outlet. The cooling apparatus also includes a drawer comprising an agitating member that is configured to agitate the container holding the liquid. The drawer is removable from the case to enable loading of the container holding the liquid to the agitating member and the drawer is replaceable in the case to enable cooling of the container holding the liquid by the cooling apparatus. The cooling apparatus further includes a power generator that includes a portion fixed to the case and that is configured to generate a driving force that causes the agitating member to agitate the container holding the liquid.

Implementations may include one or more of the following features. For example, the drawer may include a door configured to open and close a front opening of the case based on the drawer being removed and replaced in the case. The drawer may be configured to slide into and out of the case. In addition, the agitating member may be configured to swing the container holding the liquid, and the power generator may be configured to generate a driving force that causes the agitating member to swing the container holding the liquid.

In some examples, the power generator may include an electro-magnetic power generator that includes an electromagnet and that is configured to generate a driving force that causes the agitating member to agitate the container holding the liquid. In these examples, the agitating member may be configured to move based on the driving force generated by the electro-magnetic power generator, the electromagnet may be configured to selectively generate a magnetic force, and the electro-magnetic power generator may include a permanent magnet configured to be moved based on the magnetic force generated by the electromagnet, the electromagnet and the permanent magnet interacting to cause the agitating member to move. Further, in these examples, the electromagnet may be fixed to one of the case and the agitating member and the permanent magnet may be fixed to the other one of the case and the agitating member to which the electromagnet is not fixed such that one of the electromagnet and the permanent magnet moves with the agitating member and the other of the electromagnet and the permanent magnet remains fixed to the case.

In addition, the electromagnet may be fixed to the case and the permanent magnet may be fixed to the agitating member such that the permanent magnet moves with the agitating member and the electromagnet remains fixed to the case. When the drawer is replaced in the case, the electromagnet and the permanent magnet may have a relative orientation in which the electromagnet and the permanent magnet align and an air gap is defined between the electromagnet and the permanent magnet. The relative orientation may enable the electromagnet and the permanent magnet to interact when the electromagnet generates the magnetic force.

In some implementations, the power generator may include a motor configured to generate a rotation force and a power transmission unit that connects to the motor, that connects to the agitating member, and that is configured to move the agitating member based on the rotation force generated by the motor. In these implementations, the agitating member may be configured to disconnect from the power transmission unit and connect with the power transmission unit based on the drawer being removed and replaced in the case. Further, in these implementations, the power transmission unit may include a rotation member that connects to a rotation shaft of the motor and a rod with a first end that connects to the rotation member and a second end that connects to the agitating member.

The first end of the rod may be disposed at an eccentric position from a rotation center of the rotation member so that a reciprocating motion of a length direction of the rod is converted into a swinging motion of the agitating member. Also, the refrigerator may include a connection member that connects the second end of the rod to a rotation shaft of the agitating member. A position at which the second end of the rod is connected to the connection member may be eccentrically disposed from a rotation center of the agitating member.

In some examples, the at least one fan may include a suction fan that is positioned at the outlet and that is configured to draw air into the case through the inlet, draw air entering the case over the container holding the liquid positioned in the cooling apparatus, and expel air from the case through the outlet. In these examples, the refrigerator may include an evaporating compartment positioned behind the freezing compartment, an evaporator positioned within the evaporating compartment and configured to cool air to a temperature below freezing, a supply duct configured to guide air from the evaporating compartment to the inlet of the case, and a return duct configured to guide air from the outlet of the case to the freezing compartment. The suction fan may be configured to draw air from the evaporating compartment through the supply duct, through the inlet, and into the case, and expel air from the case, through the outlet, and into the return duct.

The refrigerator may include a damper positioned at the return duct and configured to open and close the return duct. When the cooling apparatus is operating, the damper may open the return duct and the suction fan may operate. When the cooling apparatus is not operating, the damper may close the return duct and the suction fan may be off.

In some implementations, the refrigerator may include a grill that is positioned at the inlet and that has multiple through holes through which air entering the case passes. The grill may increase velocity of air passing though the grill. In these implementations, the grill may be oriented such that air passing though the grill is discharged in a direction perpendicular to an outer surface of the container holding the liquid.

In another aspect, a cooling apparatus is configured to cool liquid held by a container positioned in the cooling apparatus to a refrigerated temperature. The cooling apparatus includes a case that is configured to receive the container holding the liquid and that includes an inlet and an outlet, and at least one fan configured to promote movement of air into the case through the inlet, over the container holding the liquid, and out of the case through the outlet. The cooling apparatus also includes a drawer comprising an agitating member that is configured to agitate the container holding the liquid. The drawer is removable from the case to enable loading of the container holding the liquid to the agitating member and the drawer is replaceable in the case to enable cooling of the container holding the liquid by the cooling apparatus. The cooling apparatus further includes a power generator that includes a portion fixed to the case and that is configured to generate a driving force that causes the agitating member to agitate the container holding the liquid.

The details of one or more implementations are set forth in the accompanying drawings and the description, below. Other potential features of the disclosure will be apparent from the description and drawings, and from the claims.

DETAILED DESCRIPTION

Techniques are described for quickly cooling content in a container, such as a beverage container. In some implementations, a cooling apparatus is positioned in a refrigerating compartment of a refrigerator and cools liquid held by a container to a refrigerated temperature faster than the refrigerating compartment. The refrigerated temperature is a cool temperature, but higher than a freezing temperature. The cooling apparatus includes a case that receives the container holding the liquid and that includes an inlet and an outlet, and at least one fan configured to promote movement of air into the case through the inlet, over the container holding the liquid, and out of the case through the outlet. The cooling apparatus also includes a drawer with an agitating member that agitates the container holding the liquid during cooling. The drawer is removable from the case to enable loading of the container holding the liquid to the agitating member and the drawer is replaceable in the case to enable cooling of the container holding the liquid by the cooling apparatus. The cooling apparatus also includes a power generator that includes a portion fixed to the case and that is configured to generate a driving force that causes the agitating member to agitate the container holding the liquid.

Figure 1:
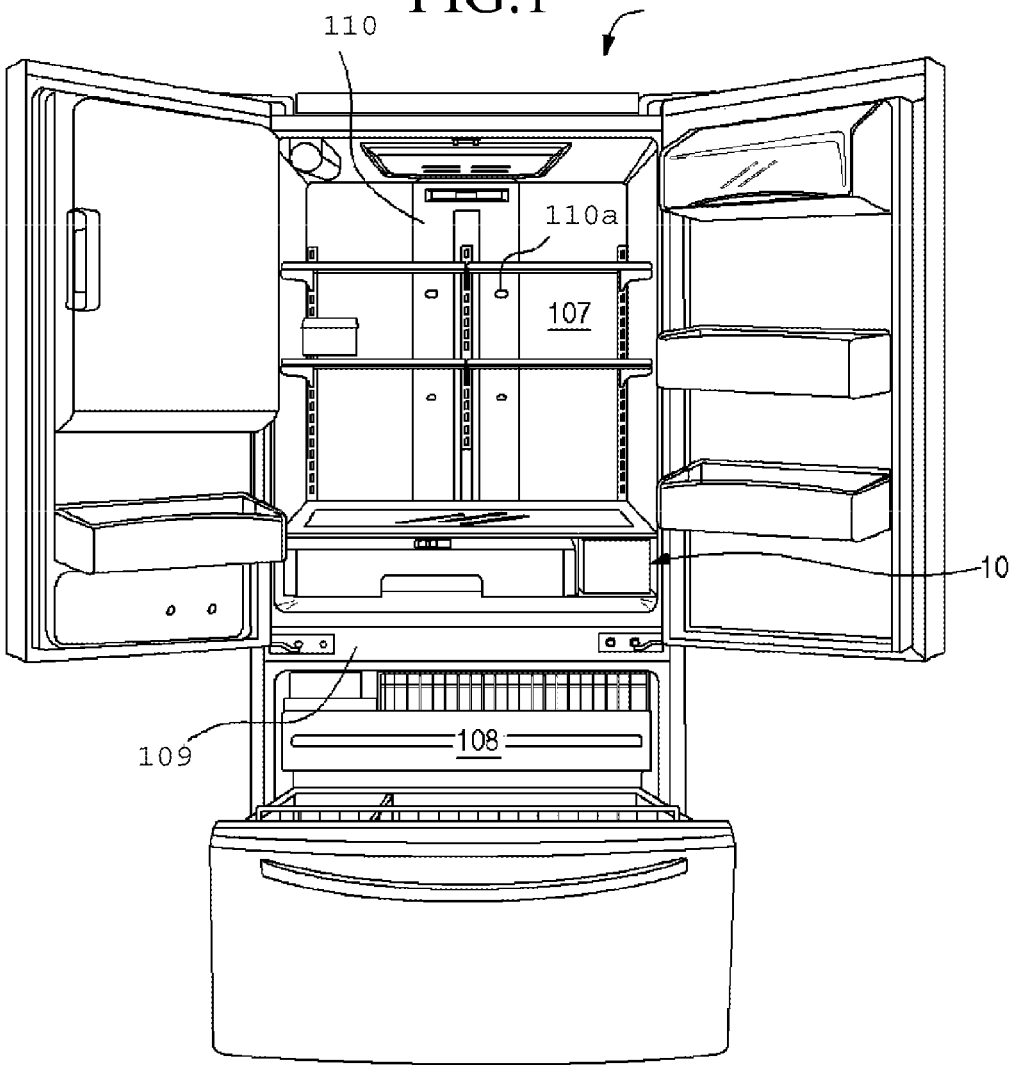
FIG. 1 is a front view of a refrigerator with a door opened.
Figure 2:
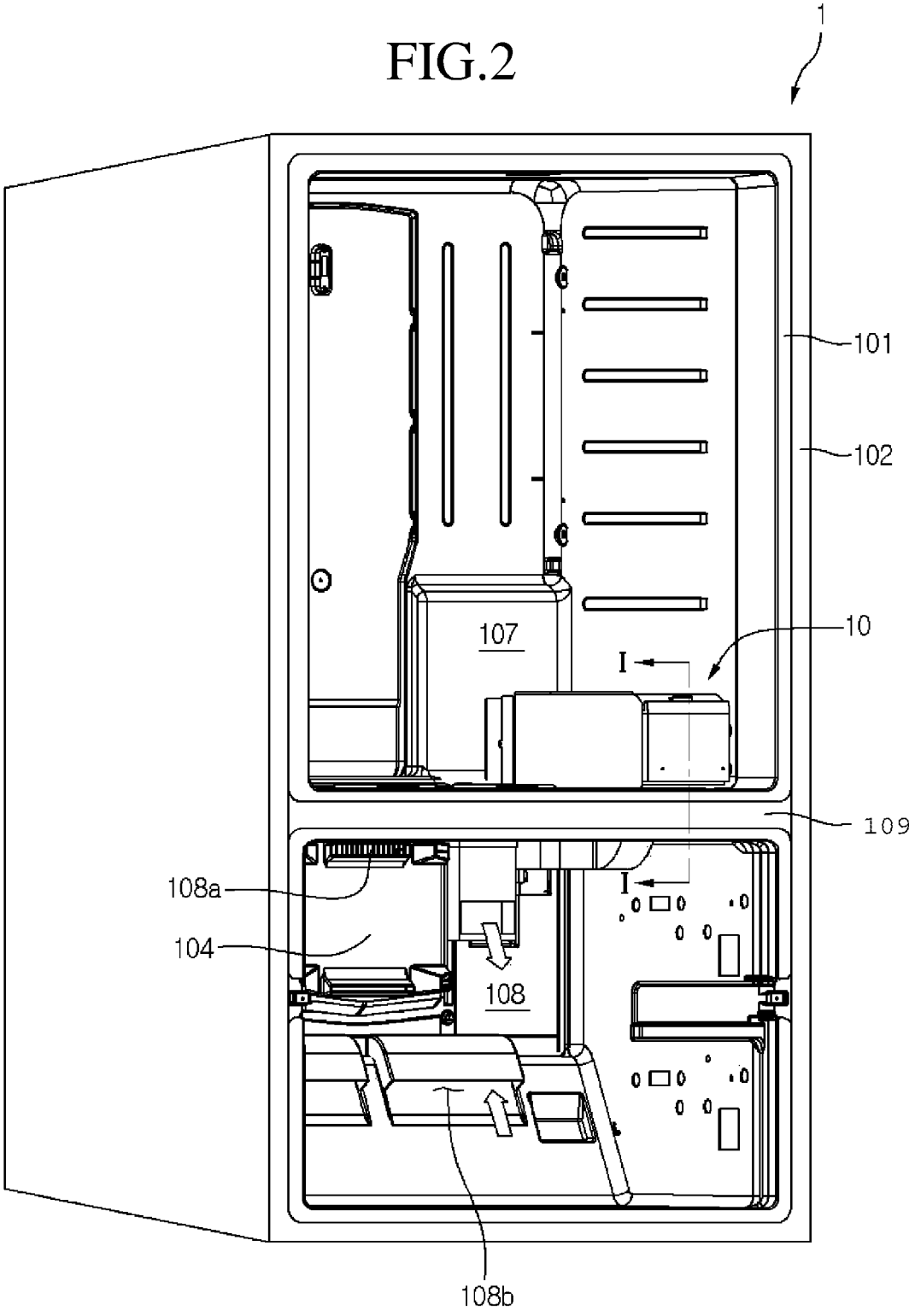
FIG. 2 is a perspective view illustrating an inner structure of a refrigerator including a cooling apparatus.
Figure 3:
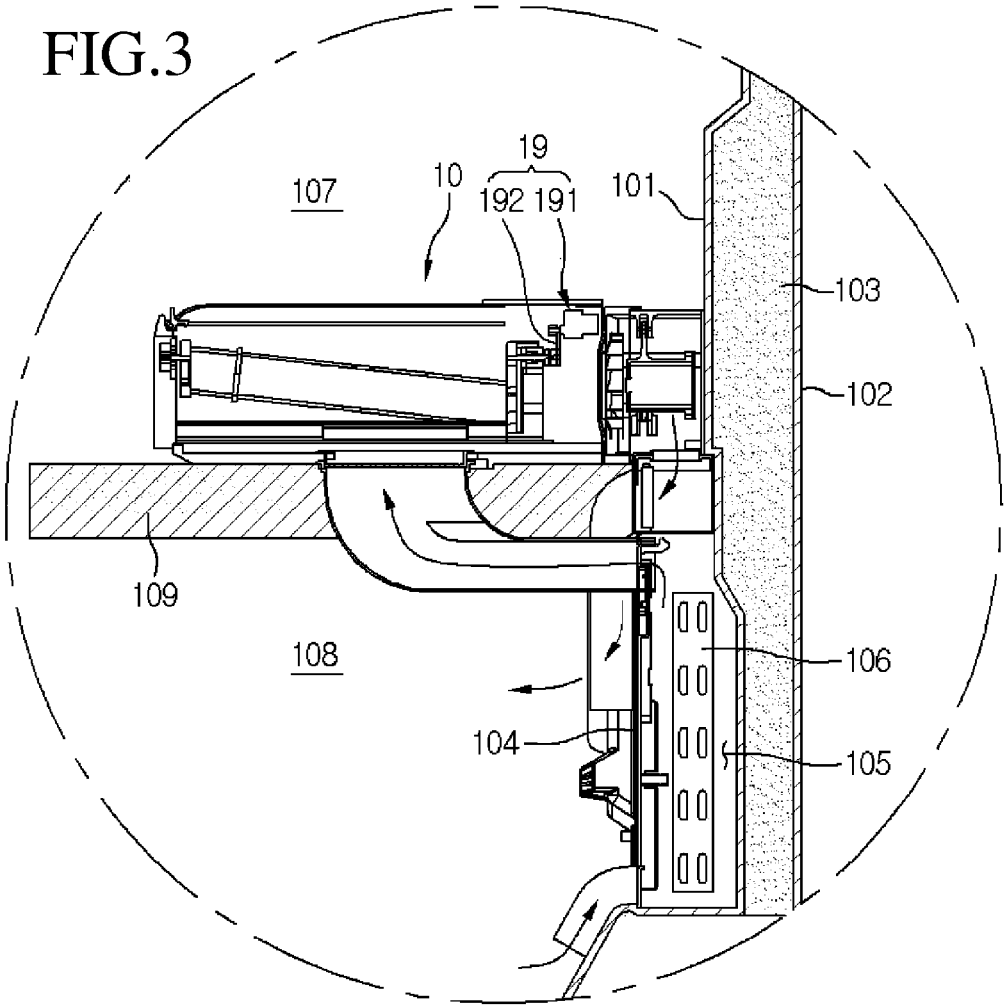
FIG. 3 is a sectional view taken along line I-I' of FIG. 2.

FIG. 1 illustrates an example refrigerator with a door opened. FIG. 2 illustrates an example inner structure of an example refrigerator including an example cooling apparatus. FIG. 3 is a sectional view taken along line I-I' of FIG. 2.

Referring to FIGS. 1 to 3, a cooling apparatus 10 may be disposed within a storage space of a refrigerator for storing a food at a low temperature.

In detail, the cooling apparatus 10 may be disposed in the refrigerator 1 to perform a quick cooling function using cool air generated in the refrigerator 1.

As shown in FIGS. 1 and 2, the cooling apparatus 10 disposed within the refrigerator is described below as an example. However, the cooling apparatus may be disposed on any apparatuses which can generate cool air or may operate as a standalone appliance.

A refrigerator 1 includes an outer case 102 defining an outer appearance of the refrigerator 1, an inner case 101 disposed inside the outer case 102 to define a storage space therein, and an insulation member 103 filling a space between the inner case 101 and the outer case 102. A body of the refrigerator 1 may be defined by the outer case 102, the inner case 101, and the insulation member 103.

Also, the storage space may include a refrigerating compartment 107 for storing food in a refrigerated state and a freezing compartment 108 for storing food in a frozen state. In this example, the storage space is vertically partitioned by a partition wall 109. Also, a bottom freezer type refrigerator in which the refrigerating compartment 107 is disposed above the freezing compartment 108 is described as an example.

However, the cooling apparatus may be disposed in a top mount type refrigerator in which the freezing compartment is disposed above the refrigerating compartment, a side-by-side type refrigerator in which the freezing compartment and the refrigerating compartment are disposed side by side, or any type of refrigerator having a freezing compartment and a refrigerating compartment.

In detail, an evaporating compartment 105 is defined in a rear surface of the freezing compartment 108 by an evaporating compartment wall 104. An evaporator 106 is received in the evaporating compartment 105. A cool air discharge hole 108*a* for discharging cool air into the freezing compartment 108 is defined in the evaporating compartment wall 104. A cool air suction hole 108*b* through which the cool air within the freezing compartment 108 returns to the evaporating compartment 105 is defined in a rear surface of a bottom of the freezing compartment 108. Also, a refrigerating compartment duct 110 extends in a vertical direction in the rear surface of the refrigerating compartment 107. A lower end of the refrigerating compartment duct 110 communicates with the evaporating compartment 105. Also, a cool air discharge hole 110*a* may be defined in a front surface of the refrigerating compartment duct 110. The cool air generated in the evaporating compartment 105 may be supplied into the refrigerating compartment 107. Also, a cool air suction hole may be defined in a side of a top surface of the partition wall 109 to allow the cool air within the refrigerating compartment 107 to return to the evaporating compartment 105.

A cooling apparatus 10 for quickly cooling drinks or alcoholic beverages may be disposed on a side of a top surface of the partition wall 109. Also, the cooling apparatus 10 may be in fluid communication with the evaporating compartment 105 and the freezing compartment 108 by the refrigerating compartment duct. For example, the cool air generated in the evaporating compartment 105 may be supplied into the cooling apparatus 10. A beverage container received in the cooling apparatus 10 may be cooled by the cool air supplied into the cooling apparatus 10. The cool air which is increased in temperature by heat-exchanging with the beverage container in the cooling apparatus 10 may return to the evaporating compartment 105. Here, the fluid communication may represent that the cool air can be circulated between the evaporating compartment 105 and the cooling apparatus 10 by a passage structure, such as a duct. Also, the beverage container may include various containers including bottles or cans in which water, drink, alcoholic beverage, or any liquid is contained. Also, the cooling apparatus 10 may include a chilling compartment defining a space for receiving the beverage container and/or a passage connecting the chilling compartment, the freezing compartment 108, and the evaporating compartment 105 to each other.

Hereinafter, a structure, operation, and function of the cooling apparatus 10 is described in more detail with reference to the accompanying drawings. Although FIG. 3 illustrates a sectional view of the cooling apparatus 10, it may be seen that the cool air is supplied into the evaporating compartment 105 by the cool air duct in the cooling apparatus 10 and discharged into the freezing compartment 108. Here, more detailed descriptions are provided below.

Figure 4:
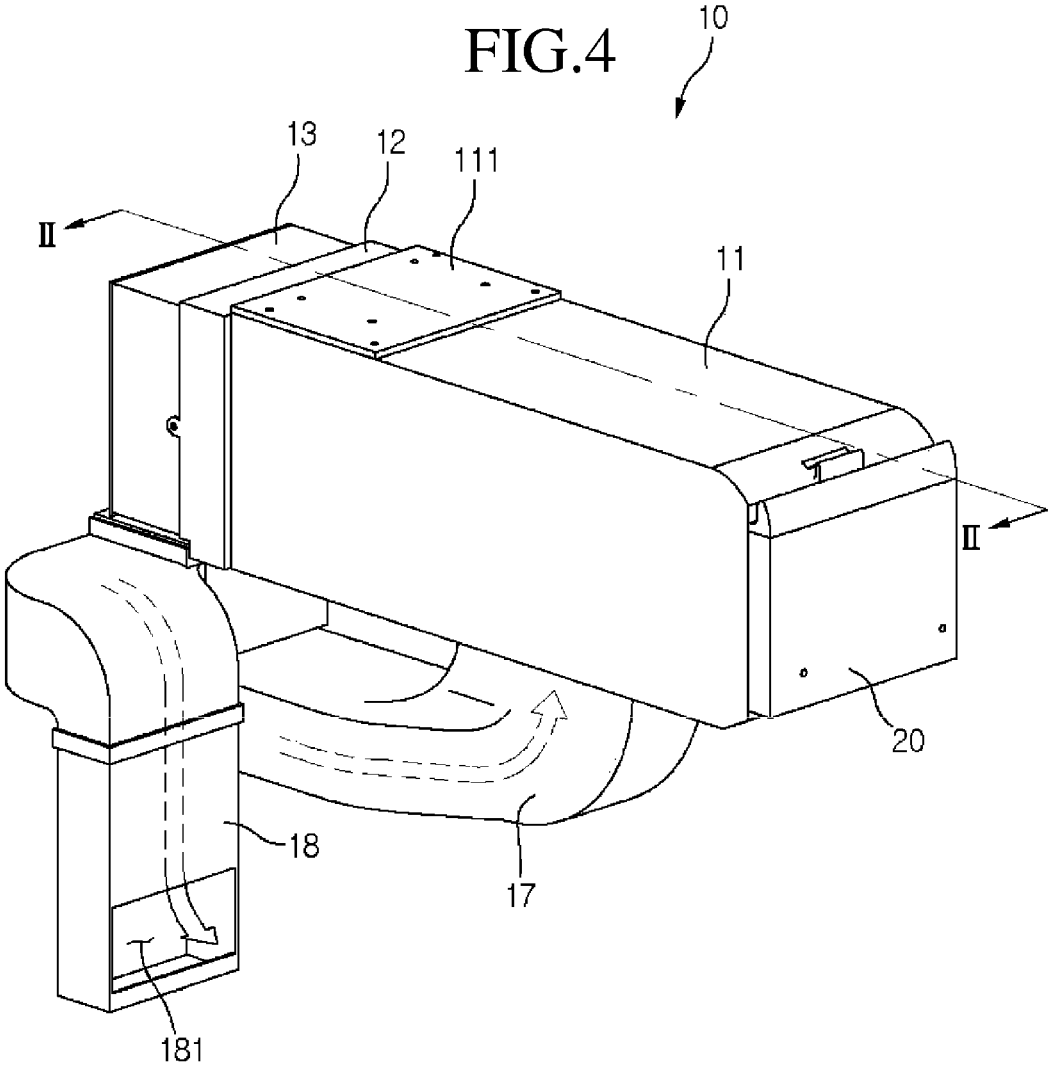
FIG. 4 is a perspective view of the cooling apparatus.
Figure 5:
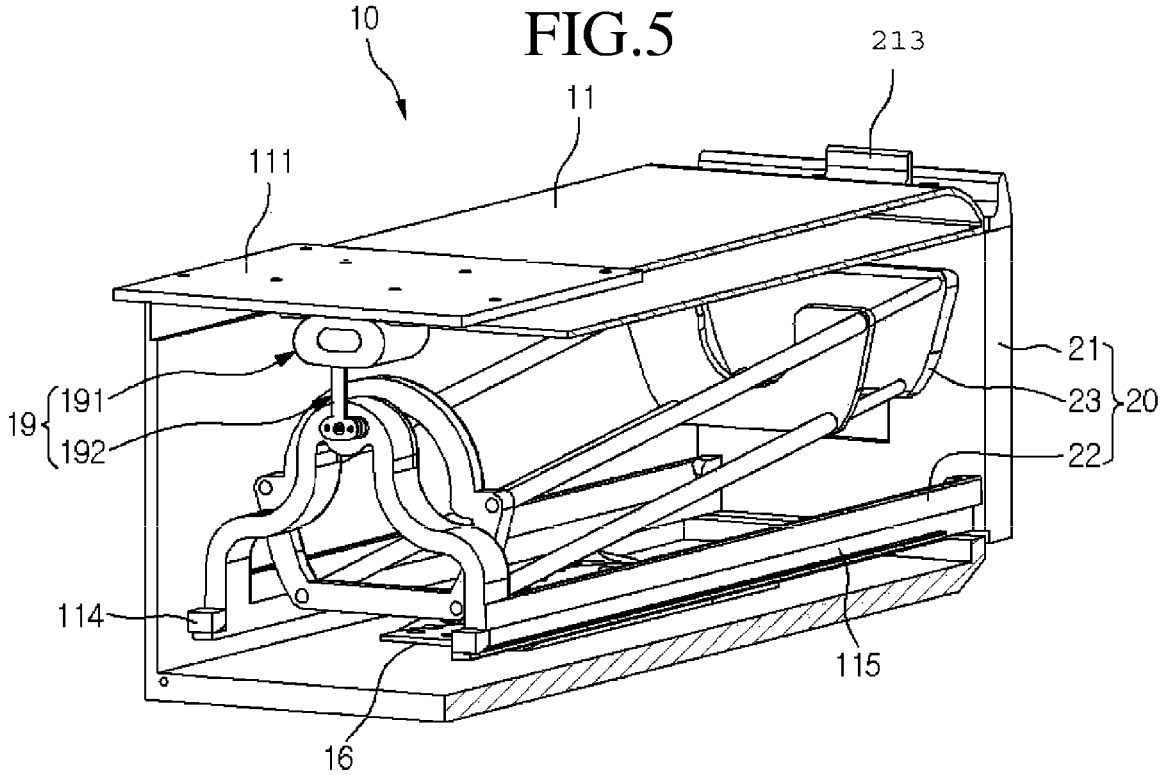
FIG. 5 is a partially cutaway perspective view illustrating a case of the cooling apparatus.
Figure 6:
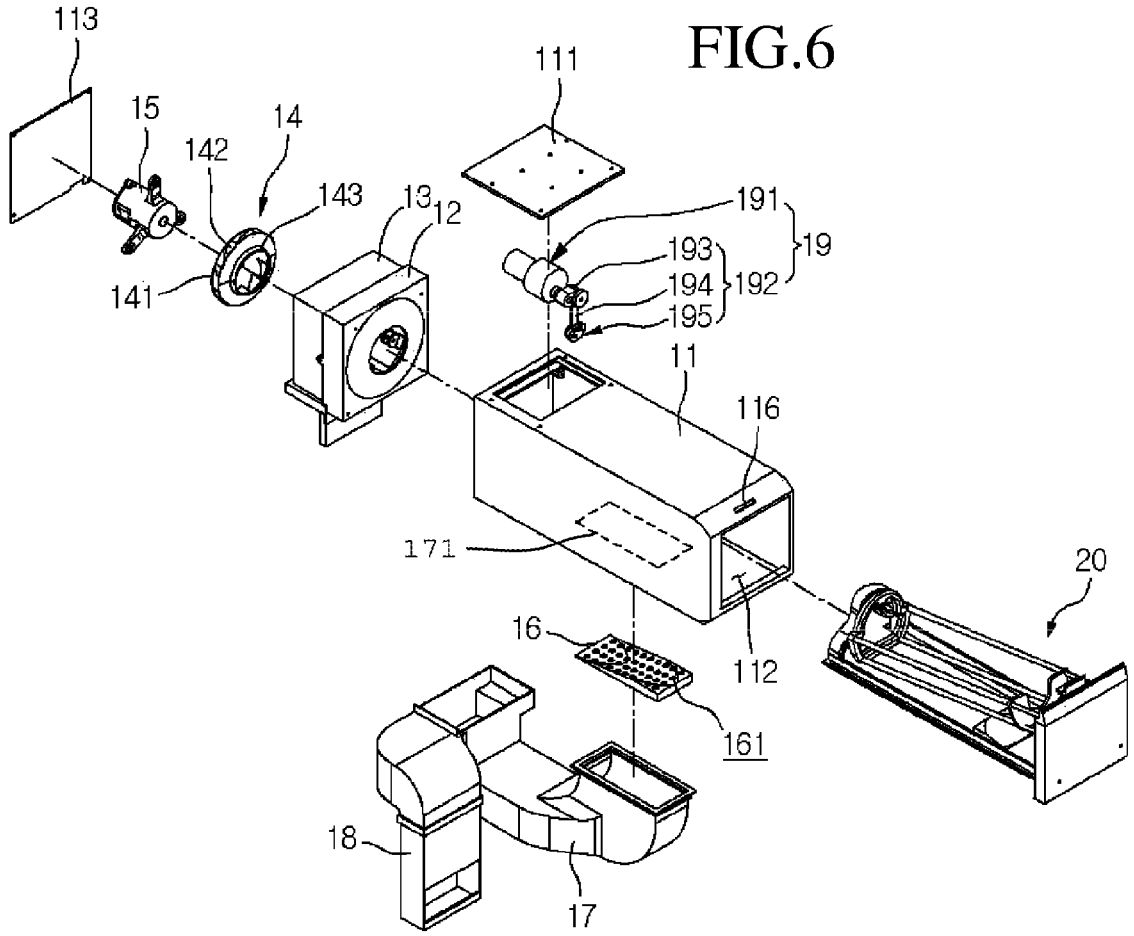
FIG. 6 is an exploded perspective view of the cooling apparatus.

FIG. 4 illustrates an example cooling apparatus. FIG. 5 is a partially cutaway perspective view illustrating an example case of the example cooling apparatus. FIG. 6 is an exploded perspective view of the example cooling apparatus.

Referring to FIGS. 4 through 6, the cooling apparatus 10 may include the chilling compartment and a cool air passage connected to the chilling compartment.

In detail, the chilling compartment may include a case 11 defining a space for storing the beverage container therein, a drawer 20 selectively received in the case 11 to seat the beverage container, and a fan assembly coupled to a rear surface of the case 11.

In more detail, the drawer 20 may be slid in front and rear directions to move into or out of the case 11. The drawer 20 may include an agitating member 23 for seating the beverage container in an inclined manner and a transfer part rotatable connected to the agitating member 23 to move the agitating member 23. The transfer part includes a door 21 for selectively opening or closing a front opening 112 of the case 11 and a frame 22 extending from a rear surface of the door 21. A detailed structure of the drawer 20 is described below.

Also, the chilling compartment may further include a power generator 19 providing a driving force so that the agitating member 23 is reciprocatively rotated in left and right directions of the case 11 within the case 11. For instance, the power generator 19 may generate force that causes the agitating member 23 to swing back and forth within the case 11.

Also, the fan assembly may include a fan 14 for forcibly blowing air, a fan housing 12 disposed on the rear surface of the case 11 in a state where the fan housing 12 receives the fan 14, a motor housing 13 disposed on a rear surface of the fan housing 12, a fan motor 15 for providing a rotation force to the fan 14 in a state where the fan motor 15 is received in the motor housing 13, and a motor mount 113 shielding the back surface of the motor housing 13 to fix the fan motor 15. The motor mount 113 may be a plate covering a rear opening of the motor housing 13.

In detail, the fan 14 may be a suction fan for sucking the cool air generated in the evaporating compartment 105 using a strong suction force.

When the suction fan is provided, air flowing into the case 11 along the cool air passage may flow at a high speed toward a rear surface of the case 11 by the strong suction force. Here, the cool air may contact an outer surface of the beverage container received in the case 11 to cause heat-exchange therebetween.

In examples in which the suction fan is used, the velocity of air may be increased when compared to examples in which a blower fan is provided.

This occurs because a pressure difference between a front area of the fan and a rear area of the fan occurs for a short time when the suction fan is provided. Also, since the velocity of air is increased, a flow rate of air per unit time may be increased. Thus, the heat exchanging between the beverage container and the cool air may be improved. Thus, heat exchange efficiency may be further improved.

Also, since the suction fan is provided, the cool air sucked by the fan may primarily heat exchange with the beverage container received in the case 11 before the cool air heat-exchanges with the motor for operating the fan.

Thus, a heat exchange rate between the cool air and the beverage container may be relatively increased to improve heat exchange efficiency. When the blower fan is provided, air sucked by the blower fan may heat-exchange with the beverage container after the air passes through the fan motor for operating the blower fan. That is, the cool air may heat-exchange with the beverage container after the cool air primarily absorbs heat while passing through the fan motor. Thus, in examples in which the suction fan is provided, the heat exchange efficiency may be further improved when compared to examples in which the blower fan is provided. That said, implementations may include blower fans used in combination with suction fans or alone.

The fan 14 may be a centrifugal fan which sucks air in an axis direction to discharge the sucked air in a radius direction. The air passing through the case 11 flows in a horizontal direction as a whole. Then, the air should flow downward to return to the evaporating compartment 105. That is, a flow direction of the air when the air passes through the case 11 intersects a flow direction of the air after the air passes through the fan 14. Thus, when a passage in which the flow directions intersect each other is provided, the centrifugal fan may be suitable.

Also, the suction fan may have a relatively low flow resistance when compared to the blower fan. For example, in case of the blower fan that pushes air, when a narrow gap or obstacle exists in an air flow passage, the air may not pass through the gas or obstacle, but flow backward. On the other hand, in case of the suction fan, air may be sucked into an inlet of the fan to cause a pressure difference. Thus, air existing at a front side of the gap or obstacle may easily pass through the gap or obstacle due to a pressure difference between the front side and a rear side of the gap. As a result, under the same condition, when the suction fan is provided, the air flow resistance may be decreased and the air flow rate may be increased.

In addition, although the fan 14 may be a kind of centrifugal fan, the fan may have a structure different from that of existing centrifugal fans. In detail, the fan 14 includes a back plate 141 having a disk shape, a blade 142 disposed on a front surface of the back plate 141, and a suction guide 143 disposed on an upper end of the blade 142.

The blade 142 may have a shape protruding forward from a front surface of the back plate 141 and having a predetermined width. Also, the blade 142 may extend in a rounded shape with a predetermined curvature in a radius direction from a center of the back plate 141. The suction guide 143 may perform complex functions, such as those performed by a bell mouth and orifice. That is, the suction guide 143 may smoothly guide the suction of air from the front side of the fan housing 12 into the fan 14 as well as reduce (e.g., prevent) air discharged in the radius direction along a surface of the blade 142 from flowing backward.

Specifically, the suction guide 143 may protrude forward from a circular bottom and have a gradually decreasing diameter. That is, the suction guide 143 may have a sectional structure which is rounded with a diameter gradually decreasing toward a front side from the bottom and then constantly maintained at a predetermined position. As described above, since the suction guide 143 has an outer surface which is smoothly rounded, the flow resistance of sucked air may be reduced (e.g., minimized). Thus, the suction guide 143 may perform the orifice function. Also, since the suction guide 143 has a cylindrical shape extending from the bottom thereof by a predetermined length, it may reduce (e.g., prevent) air sucked through an inlet of the suction guide 143 from flowing backward. Thus, the suction guide 143 may perform the bell mouth function.

The cool air passage may include a supply duct 17 for supplying the cool air generated in the evaporating compartment 105 into the case 11 and a return duct 18 for discharging the cool air within the case 11 into the freezing compartment. In detail, an inlet (or suction hole) of the supply duct 17 may communicate with the evaporating compartment 105. Also, an outlet (or discharge hole) may be connected to an under surface of the case 11. In addition, an inlet of the return duct 18 may be connected to an under surface of the motor housing 13. Further, an outlet (or discharge hole) may communicate with the freezing compartment 108. According to the example shown in FIG. 2, the discharge hole 181 of the return duct 18 may be disposed on the rear surface of the freezing compartment 108.

Also, the chilling compartment may further include a suction grill 16 detachably mounted on the underside of the case 11 and disposed on an outlet end of the suction duct 17. The suction grill 16 is disposed on the cool air inflow hole 171 which is opened in an under surface of the case 11.

Here, the cool air inflow hole 171 may be disposed at a position offset somewhat toward a rear side at an approximately central portion of the case 11. This is done because the cool air discharged from the suction grill 16 is discharged toward a lower side of the beverage container B because the beverage containers B are aligned with the inclined agitating member 23 from a rear side that is the lower side.

Alternatively, the cool air inflow hole 171 may be disposed at a center of the case 11. Here, the suction grill 16 may have a structure in which the cool air is discharged toward the lower side of the agitating member 23, e.g., the lower side.

Also, a plurality of cool air through holes 161 may be defined in the top surface of the suction grill 16. In detail, since the plurality of cool air through holes having a small diameter are defined in the bottom surface of the suction grill 16, the velocity of the cool air may be increased while passing through the outlet end of the suction duct 17, e.g., the suction grill 16. Thus, since the cool air forms a jet stream while passing through the plurality of cool air through holes, the cool air through holes may be defined as jet holes.

An upper end of the suction grill 16 may be bent and extend outward.

Thus, the upper end of the suction grill 16 may be detachably mounted on the bottom surface of the case 11 in a state where the upper end rests on the bottom surface of the case 11. Here, to address a situation in which the suction grill 16 is spaced from the bottom surface of the case 11 by the sucked air, a hook structure may be provided.

The cool air discharged through the cool air through holes 161 of the suction grill 16 may be discharged in a direction substantially perpendicular to that of an outer surface of the beverage container seated on the agitating member 23. When the cool air discharged through the cool air through holes 161 contacts the beverage container in a vertical direction, cooling efficiency of the beverage container may be good.

For this, the suction grill 16 having the cool air through holes 161 may be inclined with respect to the agitating member 23 or an inclined surface of the beverage container loaded on the agitating member 23. Thus, the cool air may be vertically discharged toward the beverage container through the cool air through holes 161 defined in the inclined suction grill 16.

The cool air through holes 161 may be opened in an inclined direction.

Also, a separate guide may be disposed around the cool air through holes 161 to allow the cool air discharged through the cool air through holes 161 to be discharged toward the lower side of the agitating member 23. Thus, the cool air discharged through the cool air through holes 161 may vertically contact the beverage container seated on the agitating member 23 and then be discharged toward a rear side of the fan 14.

The power generator 19 may include a driving motor 191 for generating a rotation force and a power transmission unit 192 connecting the driving motor 191 and the agitating member 23 to each other to rotate the agitating member 23. The power generator 19 is described below in more detail.

A latch groove 116 may be defined in a side of a front surface of the case 11. A door latch 213 rotatable disposed on the drawer 20 may connect to the latch groove 116. A hook protrusion 114 may protrude inside the case 11 to reduce (e.g., prevent) shaking of the drawer 20 in a state where the drawer 20 is completely disposed within the case 11 and as also may stop the drawer 20 from being taken out by itself during rotation of the agitating member 23. In detail, the hook protrusion 114 may protrude from an inner side surface of the case 11. A unit for hooking the hook protrusion 114 may be disposed on the drawer 20. This may be seen in FIG. 9.

Also, a guide rail 115 for guiding the drawer 20 in front and rear directions may protrude from the inner side surface of the case 11. The guide rail 115 may horizontally extend from a front end of the case 11 to a rear end.

Figure 7:
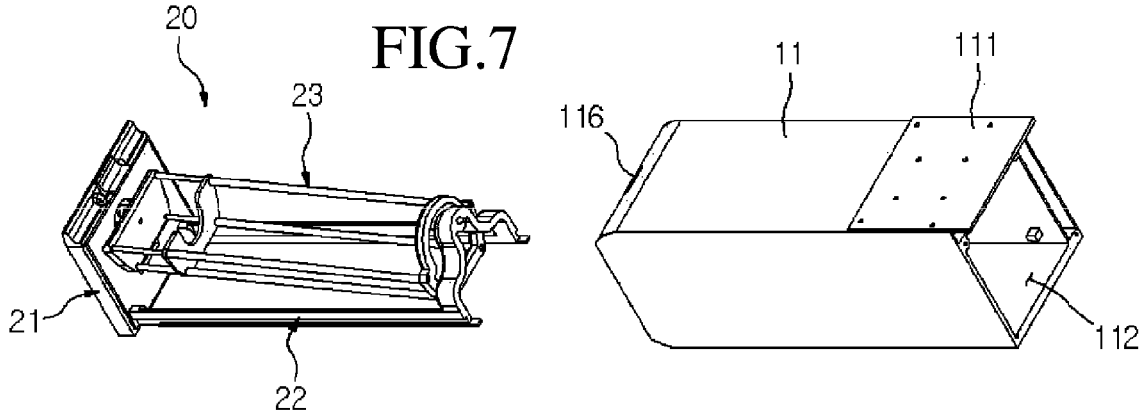
FIG. 7 is an exploded perspective view illustrating a state in which a drawer and case constituting the cooling apparatus are separated from each other.
Figure 8:
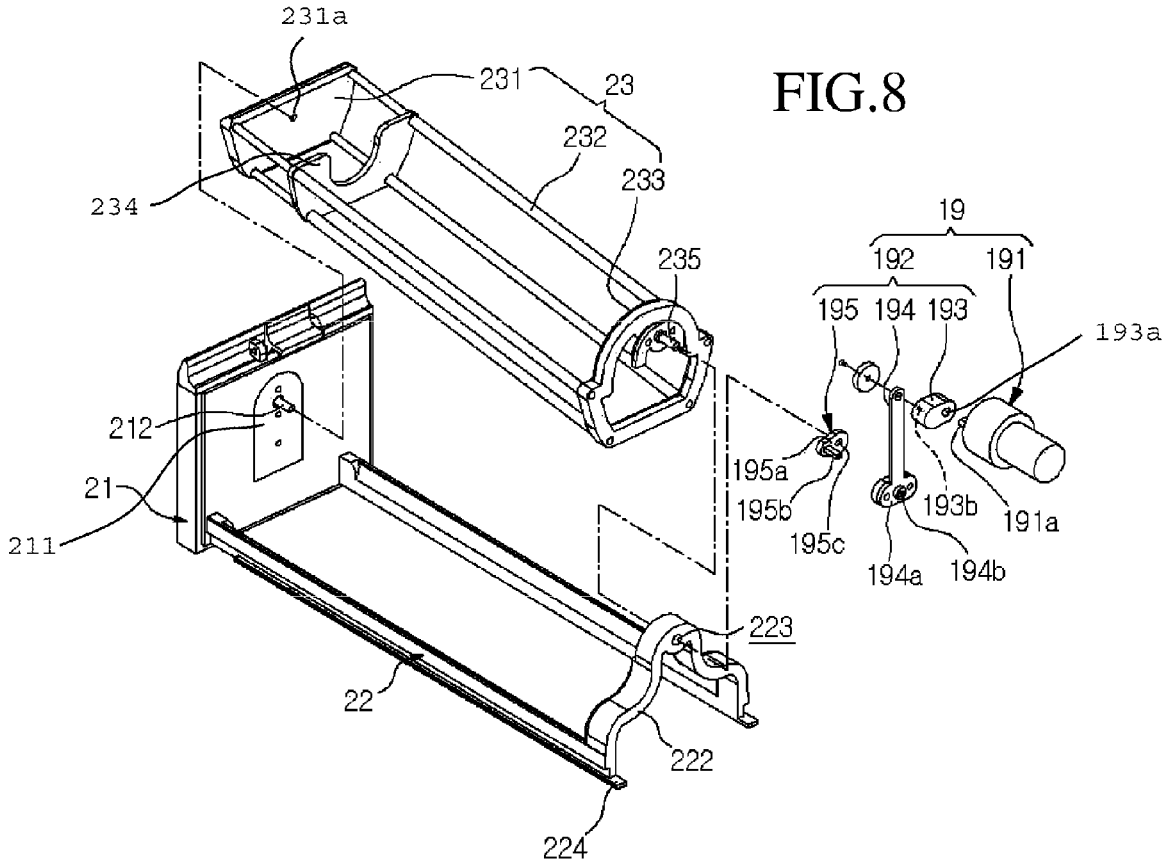
FIG. 8 is an exploded perspective view of the drawer.
Figure 9:
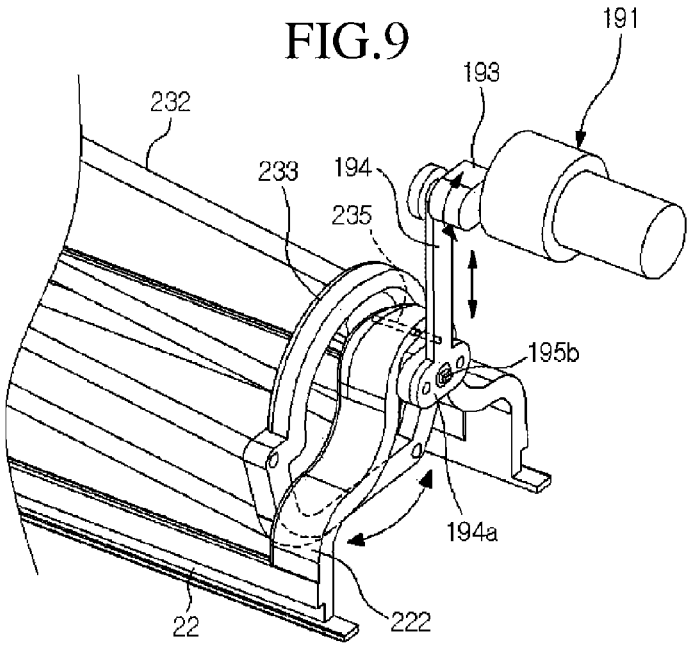
FIG. 9 is a partial perspective view illustrating a connection structure between a power generator and a power transmission unit.

FIG. 7 illustrates a state in which a drawer and case constituting the cooling apparatus are separated from each other. FIG. 8 illustrates an example drawer. FIG. 9 illustrates an example connection structure between an example power generator and an example power transmission unit.

Referring to FIGS. 7 to 9, the drawer 20 of the cooling apparatus 10 includes a transfer part constituted by a door 21 and a frame 22 and an agitating member 23.

In detail, as described above, the door 21 selectively opens or closes the front opening 112 of the case 11. A handle part to be grasped by user's fingers may be disposed on a top surface of the door 21. As an example handle part, a stepped part 214 in which a rear side of the top surface of the door 21 is stepped at a predetermined depth may be provided. The door latch 213 may be rotatable disposed forward on the stepped part 214. An elastic member, such as a torsion spring, may be disposed on a rotation shaft of the door latch 213. When the door latch 213 is pulled and then released, the door latch 213 may return to its original position.

Also, the door latch 213 may be rotatable in the withdrawal direction of the drawer 20. Thus, when the user pulls the stepped part 214 to open the drawer 20, the user may pull the door latch 213 together with the stepped part 214. A latch groove 116 in which the door latch 213 is inserted may be defined in the front surface of the case 11. In detail, the front portion of the case 11 in which the latch groove 116 is defined may be smoothly inclined backward. That is, when the door 21 is closely attached to the front opening 112 of the case 11 to close the drawer 20, the door latch 213 may be tilted forward while being slid along a rounded top surface of the case 11.

When the door latch 213 is inserted into the latch groove 116, the door latch 213 may be rotated backward by an elastic restoring force to return to its original position. Therefore, since it is unnecessary to rotate the door latch 213 forward to fix the door 21 of the drawer 20 to the case 11, convenience of use may be improved.

Also, a buffer part 211 may protrude from a back surface of the door 21. When the agitating member 23 is rotated or the drawer 20 is withdrawn, the buffer part 211 may stop (e.g., prevent) the agitating member 23 from bumping against the back surface of the door 21. Also, a support shaft 212 for rotatable supporting a front end of the agitating member 23 may protrude from a center of the buffer part 211.

Also, the frame 22 may extend from the back surface of the door 21. In detail, the frame 22 may include a pair of side frames 221 extending from edges of both side surfaces of the door 21 and a rear frame 222 extending upward from an end of each of the side frames 221 to connect the pair of side frames 221 to each other. A shaft insertion hole 223 in which a rotation shaft 235 protruding from a rear end of the agitating member 23 is inserted may be defined in an upper end of the rear frame 222. A shape of the frame 22 is not limited to the illustrated shape, and thus, the frame 22 may have various shapes. For example, when the rear frame 222 has a plate shape, the rear frame 222 may have a structure in which the rear frame 222 is perpendicularly coupled to the ends of the pair of side frames 221.

A stepped part in which the guide rail 115 disposed on the inner side surface of the case 11 is received may be disposed in an outer under surface of each of the pair of side frames 221. That is, the pair of side frames 221 may be moved in front and rear directions in a state where the side frames 221 are seated on the guide rail 115. A hook end 224 may protrude from the end of each of the side frames 221. The hook end 224 may be closely attached to an under surface of the hook protrusion 114 protruding from the inner side surface of the case 11. As described above, this structure may be an example of a locking mechanism for stopping the drawer 20 from being separated by itself in a state where the drawer 20 is completely inserted into the case 11. Particularly, when the drawer 20 is completely pushed into the case 11, the hook end 224 is closely attached to the under surface of the hook protrusion 114. This is clearly shown in the section view of FIG. 10. Here, to improve a coupling force (or frictional force) between the hook protrusion 114 and the hook end 224, the following structure may be used. That is, the top surface of the hook end 224 has a height slightly higher than that of the under surface of the hook protrusion 114. Also, the hook end 224 has a rounded top end. Thus, the top surface of the hook end 224 may be pressed in a state where the top surface contacts the under surface of the hook protrusion 114 to cause a frictional force. The hook protrusion 114 may be relatively moved along the rounded top surface of the hook end 224. Thus, the drawer 20 does not shake after it is completely inserted into the case 11. Furthermore, the door latch 213 may be fitted into the latch groove 116 defined in the case 11 to stop the drawer 20 from be separated.

Hereinafter, the agitating member 23 is described.

The agitating member 23 is a unit for shaking the beverage container in a state where the beverage container is received therein. In detail, the agitating member 23 may include a front support 231 defining a front surface of the agitating member 23, a rear support 233 defining a rear surface of the agitating member 23, and a plurality of holder shafts 232 connecting the front support 231 to the rear support 233 to dispose the beverage container B at a predetermined inclined angle.

The front support 231 has a plate shape. Holder shafts 232 may be coupled to each of both left and right edges of upper and lower portions of the front support 231. A shaft insertion hole 231*a* in which the support shaft 212 protruding from the back surface of the door 21 is inserted may be defined in an upper portion of the front support 231. Thus, the front support 231 is rotatable shaft-coupled to the back surface of the door 21. Here, the shaft insertion hole 231*a* may be disposed relatively close to a center of the front support 231 so that a rotation vibration of the front support 231 is decreased. That is, a horizontal plane passing through a rotation center of the front support 231 may pass between the upper and lower holder shafts 232.

Thus, an upper portion of the beverage container B seated on the holder shaft 232 may be relatively less shaken.

The holder shaft 232 may extend in a parallel bar shape and be connected to the front support 231 and the rear support 233. The holder shafts 232 may be provided in pair on upper and lower sides. The holder shafts 232 may be spaced a predetermined distance from each other so that the beverage container B is received in a space defined by the plurality of holder shafts 232. Also, the cool air smoothly flows between the holder shafts 232.

Also, a distance between the holder shafts 232 disposed at the lower side among the plurality of holder shafts 232 may be less than that between the holder shafts 232 disposed at the upper side. Thus, the beverage container B may be further stably seated. The holder shafts 232 are disposed on edges of the front support 231 and the rear support 233.

Also, a neck holder 234 for supporting a neck portion of bottle such as a wine bottle may be disposed on the holder shaft 232. The neck holder 234 may be movably disposed along the holder shaft 232 to adjust its position according to a size of the bottle.

The rear support 233 may be disposed to open a portion except a circumference portion at which the plurality of holder shafts 232 are disposed. That is, a central portion of the rear support 233 may be opened to allow the cool air to smoothly flow through the opening of the rear support 233 when the cool air flows.

Also, the rotation shaft 235 protrudes from a rear surface of the rear support 233. The rotation shaft 235 has one end inserted into the rear support 233 and the other end coupled to a power transmission unit 192 that is described in more detail below. Thus, when the rotation shaft 135 is rotated with a predetermined path by the power transmission unit 192, the rear support 233 may perform a swinging motion.

Also, the rotation shaft 235 may be inserted into the shaft insertion hole 223 defined in the rear frame 222. Here, the rotation shaft 235 may be disposed above the holder shaft 232.

A swing central axis of the agitating member 23 may be inclined upward with respect to a horizontal plane from a rear end of the agitating member 23 to a front end. Thus, the neck portion of the received beverage container may be inclined at a large angle.

Also, a rotation center of the rear end of the agitating member 23 is disposed at a point close to an upper end of the rear support 223. Also, a rotation center of the front end of the agitating member 23 is disposed at a point close to a center of the front support 231. Thus, the rear end of the agitating member 23 has a swing trace greater than that of the front end. As a result, a swing trace of a lower portion of the beverage container B seated on the agitating member 23 may be larger to actively agitate the beverage within the beverage container B. The cool air sucked at high velocity through the suction grill 16 disposed on the bottom of the case 11 may contact against the beverage container to heat-exchange with the beverage.

Hereinafter, the power generator is described.

The power generator 19 may include a driving part 191 for generating a rotation power and a power transmission unit 192 for transmitting the rotation force of the driving motor 191 to swing the agitating member 23.

In detail, the driving motor 191 has the same structure as that of a general electric motor and may be disposed on the cover plate 111. As necessary, the driving motor 191 may be disposed inside the case 11. Also, if the driving motor 191 is connected to the agitating member 23, the driving motor 191 may be disposed outside the case 11.

A stepping motor which can be forwardly or reversely rotated at a predetermined angle may be used as the driving motor 191. Thus, the driving motor 191 may be configured to be repeatedly rotated at a predetermined angle in forward or reverse direction. Also, the agitating member 23 may be configured to perform a swing motion.

Also, the driving motor 191 may be turned off after it is rotated at a predetermined angle. When the driving motor 191 is turned off after it is rotated at a predetermined angle, the rotation shaft 191*a* of the driving motor 191 may be reversely rotated by self-weight of the power transmission unit 192 connected to the rotation shaft 191*a* of the driving motor 191. Thus, the rotation shaft 191*a* of the driving motor 191 and the power transmission unit 192 may be return to their original positions. Thus, the driving motor 191 may allow the agitating member 23 to perform the swing motion due to continuous ON/OFF of the driving motor.

The power transmission unit 192 is disposed on the driving motor 191.

The power transmission unit 192 includes a rotation member 193 connected to the rotation shaft of the driving motor 191, a rod shaft-coupled to the rotation member 193 and vertically moved, and a connection member 195 connecting the rotation shaft 235 connected to the agitating member 23 to the rod 194.

In detail, the rotation member 193 is coupled to the rotation shaft 191*a* of the driving motor 191 and rotated at a predetermined angle. Also, the rotation member 193 has one side having a rotation shaft hole 193*a* coupled to the driving motor 191 and the other side having a coupling hole 193*b* coupled to an upper end of the rod 194. That is, the rotation shaft 191*a* of the driving motor 191 is eccentrically connected to the rotation member 193.

The rotation shaft hole 193*a* has a sectional shape corresponding to that of the rotation shaft 191*a* of the driving motor 191. When the rotation shaft 191*a* of the driving motor 191 is inserted, the rotation shaft 191*a* of the driving motor 191 and the rotation member 193 may be rotated together with each other. A pin or screw may be coupled to the coupling hole 193*b*. An upper end of the rod 194 may be shaft-coupled to vertically move the rod 194 when the rotation member 193 is rotated.

The rod 194 has a long stick shape to connect the rotation member 193 to the connection member 195. Also, an upper end of the rod 194 is rotatable shaft-coupled to coupling hole 193*b*. A clutch part 194*a* is disposed on a lower end of the rod 194. The clutch part 194*a* rotates the connection member 195. Also, the clutch part 194*a* may be disposed on the lower end of the rod 194 and have a clutch hole 194*b* in which a connection member shaft 195*b* disposed on the connection member 195 is inserted.

The connection member 195 converts a vertical movement of the rod 194 into a rotation movement. The connection member 195 includes a connection member plate 195*a* having a predetermined length and the connection member shaft 195*b* protruding from an edge of a side of the connection member plate 195*a*.

A connection member hole 195*c* is defined in an edge (a position spaced from the connection member shaft 195*b*) of the other side of the connection member plate 195*a*. An end of the rotation shaft 235 is inserted into the connection member hole 195*c*. Here, the connection member hole 195*c* has a shape corresponding to a sectional shape of the rotation shaft 235. Thus, the connection member 195 may be integrally rotated with the rotation shaft 235. That is, since the rotation shaft 235 is connected, the rear support 233 and the connection member 195 may be rotated together with each other.

Thus, when the driving motor 191 is repeatedly rotated at a predetermined angle in forward or reverse direction, the rotation member 193 may be repeatedly rotated at the same angle. Thus, the rod 194 may be vertically moved. The connection member 195 may be repeatedly rotated at a predetermined angle in forward or reverse direction due to the vertical movement of the rod 194. Also, the agitating member 23 may be repeatedly swung at a predetermined angle due to the rotation of the connection member 195.

Figure 10:
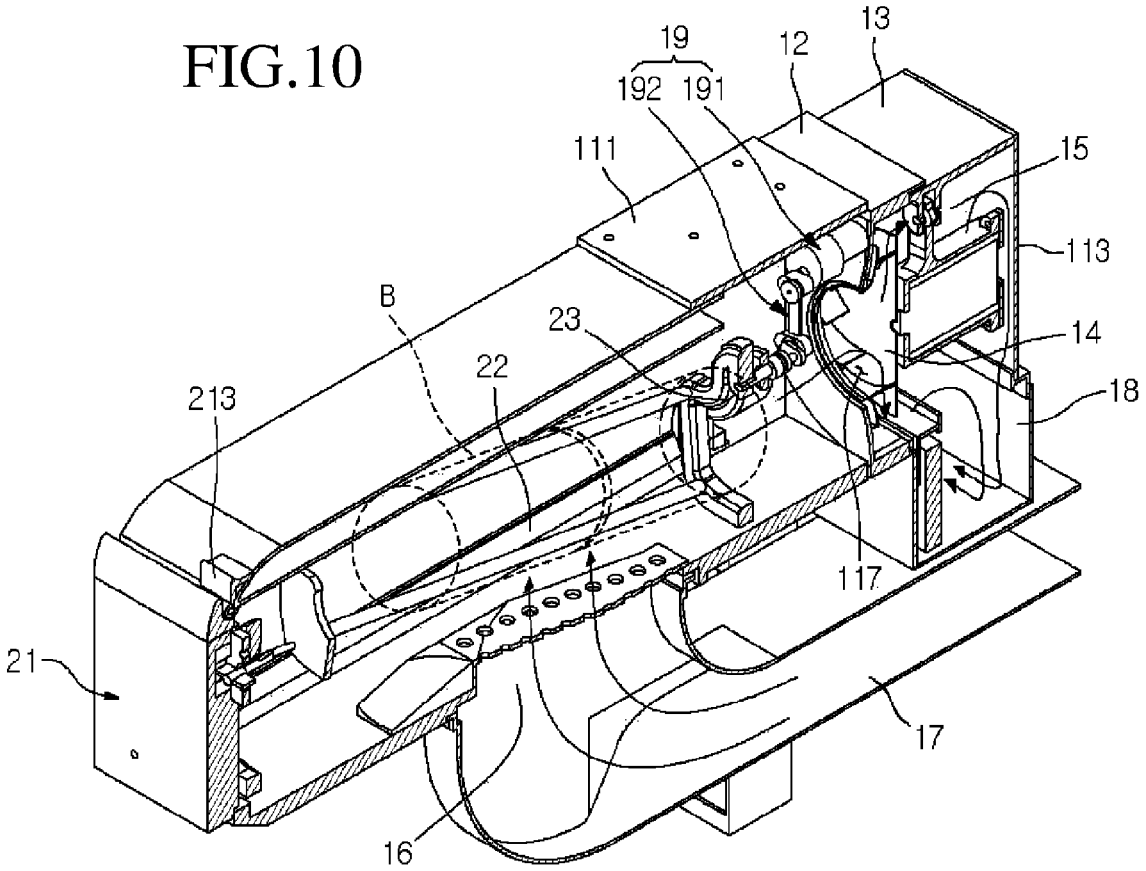
FIG. 10 is a sectional view taken along line II-II of FIG. 4.
Figure 11:
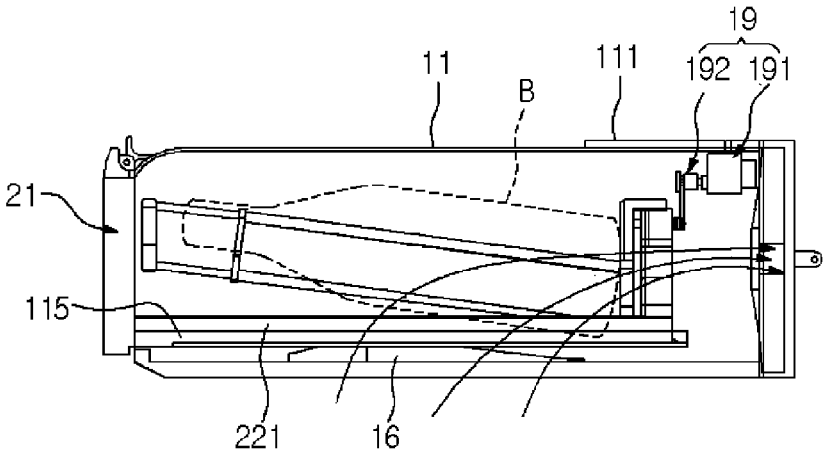
FIG. 11 is a side sectional view illustrating a flow of cool air in the cooling apparatus.
Figure 12:
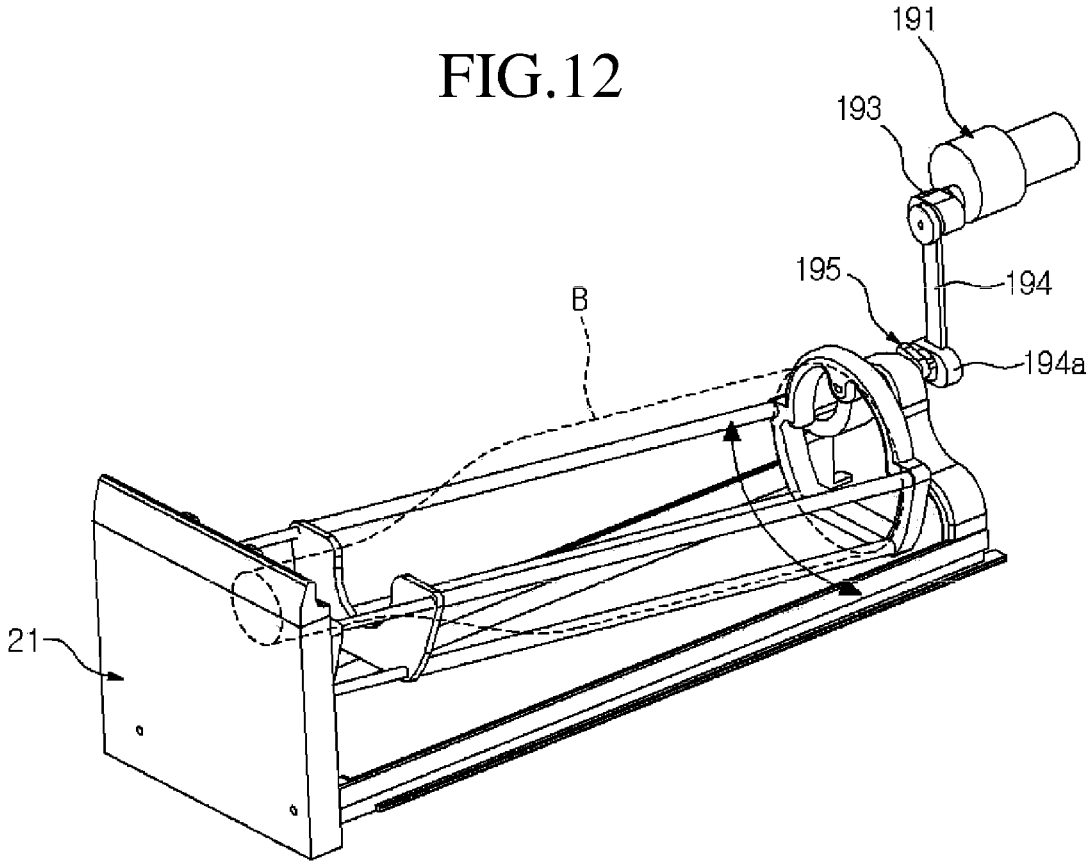
FIG. 12 is a perspective view illustrating a swing state of an agitating member.

FIG. 10 is a sectional view taken along line II-II of FIG. 4. FIG. 11 illustrates an example flow of cool air in the cooling apparatus. FIG. 12 illustrates an example swing state of an agitating member.

Referring to FIGS. 10 through 12, a discharge end of a suction duct 17 is connected to the under surface of a chilling compartment, e.g., the under surface of the case 11. The suction grill 16 is disposed on a position to which the discharge end of the suction duct 17 is connected. Thus, air sucked through the suction duct 17 may be increased in velocity while passing through the suction grill 16. As described above, this may be achieved by the cool air through holes 161 defined in the suction grill 16.

Also, a point to which the discharge end of the suction duct 17 is connected may be disposed close to a rear end of the beverage container B, e.g., the rear support 233, to increase a contact area between the beverage container B and the cool air. Particularly, the beverage container B may be inclined to allow fluid within the beverage container B to be concentrated into a lower portion of the beverage container B. Also, the cool air may be concentrated into the lower portion of the beverage container B to increase a heat exchange amount between the cool air and the beverage, thereby effectively performing quick cooling.

Also, as described above, the cool air passing through the suction grill 16 at a high speed may be discharged in a direction perpendicular to that of an outer surface of the beverage container B. For this, the suction grill 16 may have an inclined surface corresponding to an inclination of the agitating member 23. As necessary, the air holes may be varied in shape so that the cool air is discharged in a direction inclined backwardly.

A cool air discharge hole 117 for discharging the cool air is defined in the rear surface of the case 11. The cool air discharge hole 117 fluidly communicates with the fan housing 12 and the case 11 through the cool air discharge hole 117. The fan 14 is disposed within the fan housing 12. A front end of the suction guide 143 of the fan 14 is disposed on the cool air discharge hole 117. Thus, when the fan 14 is rotated, the cool air passing through the cool air discharge hole 117 is introduced into the suction guide 143 and discharged in a radius direction of the fan 14 by the blade 142.

Also, the motor housing 13 is connected to a rear side of the fan housing 12. Here, the fan housing 12 communicates with the motor housing 13.

Thus, the cool air discharged in the radius direction of the fan 14 flows into the motor housing 13 to cool the motor 15. A suction end of the return duct 18 is connected to a bottom of the motor housing 13. Thus, the cool air guided into the motor housing 13 is discharged into the freezing compartment 108 through the return duct 18.

Here, as described above, the fan 14 may be a suction fan for sucking air that is disposed on the rear surface of the case 11. Thus, the cool air sucked through the suction duct 17 cools the beverage contained in the beverage container, and then flows into the motor housing 13 to cool the motor 15. The cool air having a temperature increased by performing heat-exchange two times is introduced into the freezing compartment through the return duct 18.

The swing motion of the agitating member 23 and the rotation of the fan 14 may be performed at the same time. For this, the driving motor 191 is rotated. The driving motor 191 is forwardly or reversely rotated at a predetermined angle. As the rotation shaft 191*a* of the driving motor 191 is rotated, the rotation member 193 is rotated. Since the rotation member 193 is rotated, the rod 194 is vertically moved. Also, since the rod 194 is vertically moved, the connection member 195 is rotated. Since the connection member 195 is rotated together with the rotation shaft 235 coupled to the rear support 233 of the agitating member 23, the agitating member 23 is reciprocatively rotated at a predetermined angle, e.g., swung.

When the agitating member 23 is swung while the cool air is sucked by the fan 14, liquid within the beverage container B may be agitated and quickly cooled. Specifically, a rear portion of the agitating member 23, e.g., a lower portion of the beverage container B may have a swing path greater than that of an upper portion of the beverage container B. Thus, the agitation may be actively performed at the lower portion of the beverage container B. Thus, the cool air may be concentrated into the lower portion to effectively cool the beverage container.

Hereinafter, a user interface function in which a temperature of the beverage container received in the cooling apparatus is detected to confirm a quick cooling time, a remaining time until the quick cooling is finished, and a current temperature of the beverage container is described. Here, configurations and operations of a cooling apparatus and an agitating member are slightly different from those of the above examples.

However, a structure and idea of a temperature sensor or user interface which is described below may be equally applied to any cooling apparatus. That is, a configuration of the agitating member or a kind of the power generator does not affect the realization of the beverage container detection and user interface, which is described later.

Figure 13:
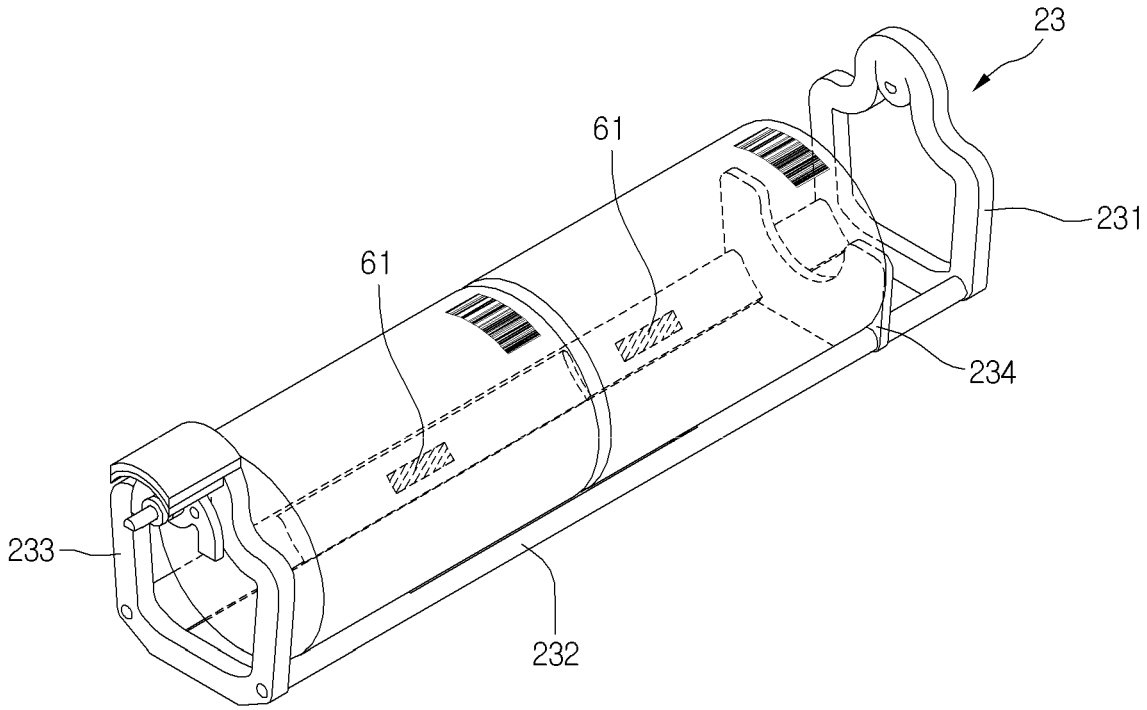
FIG. 13 is a perspective view illustrating the agitating member of the cooling apparatus including a temperature detection mechanism.

FIG. 13 illustrates an example agitating member of an example cooling apparatus including an example temperature detection mechanism.

Referring to FIG. 13, as described above, an agitating member 23 includes a front support 231, a holder shaft 232, and a rear support 233. Here, structural differences of the front support 231, the holder shaft 232, and the rear support 233 of the agitating member 23 of FIG. 8 do not affect the realization of a temperature detection mechanism.

In detail, the holder shaft 232 includes a pair of bars spaced a predetermined distance from each other. The pair of bars is connected to the front support 231 and the rear support 233, respectively. A space defined inside the holder shaft 233 may provide a passage through which cool air supplied through the suction grill 16 contacts against an outer surface of the beverage container to heat-exchange with the beverage container. Also, a portion of the outer surface of the beverage container may contact the holder shaft 232.

Furthermore, one or more contact type temperature sensors 61 may be disposed on an inner side surface of the holder shaft 232, e.g., a surface contacting the outer surface of the beverage container. The contact type temperature sensor 61 may include various types of existing temperature sensors, such as a thermistor, a thermocouple, and an integrated circuit (IC) temperature sensor.

For example, the thermistor represents a device in which a resistance is varied according to a temperature. The thermistor may include a negative temperature coefficient (NTC) thermistor in which a resistance is decreased when a temperature is increased, a positive temperature coefficient (PTC) thermistor in which a resistance is increased when a temperature is increased, and a critical temperature resister (CTR) thermistor in which a resistance is significantly reduced at a specific temperature when a temperature is increased.

A plurality of can beverages or a single wine bottle may be supported by the holder shaft 232. Thus, at least a plurality of contact type temperature sensors 61 spaced a predetermined distance from each other may be disposed on the holder shaft 232. Also, only one sensor or the plurality of sensors may be operated according to the position of the beverage container.

As described above, the contact type temperature sensor 61 may be disposed on the agitating member 23 to detect a temperature of the beverage container at a time at which the beverage container is received in the cooling apparatus 10 as well as detect a current temperature of the beverage container to inform the detected temperature to a user. Also, a quick cooling ending time may be determined through a temperature value of the beverage container detected by the contact type temperature sensor 61. That is, the cooling apparatus may be programmed so that a quick cooling mode is stopped when a temperature of the beverage container reaches a target temperature.

Figure 14:
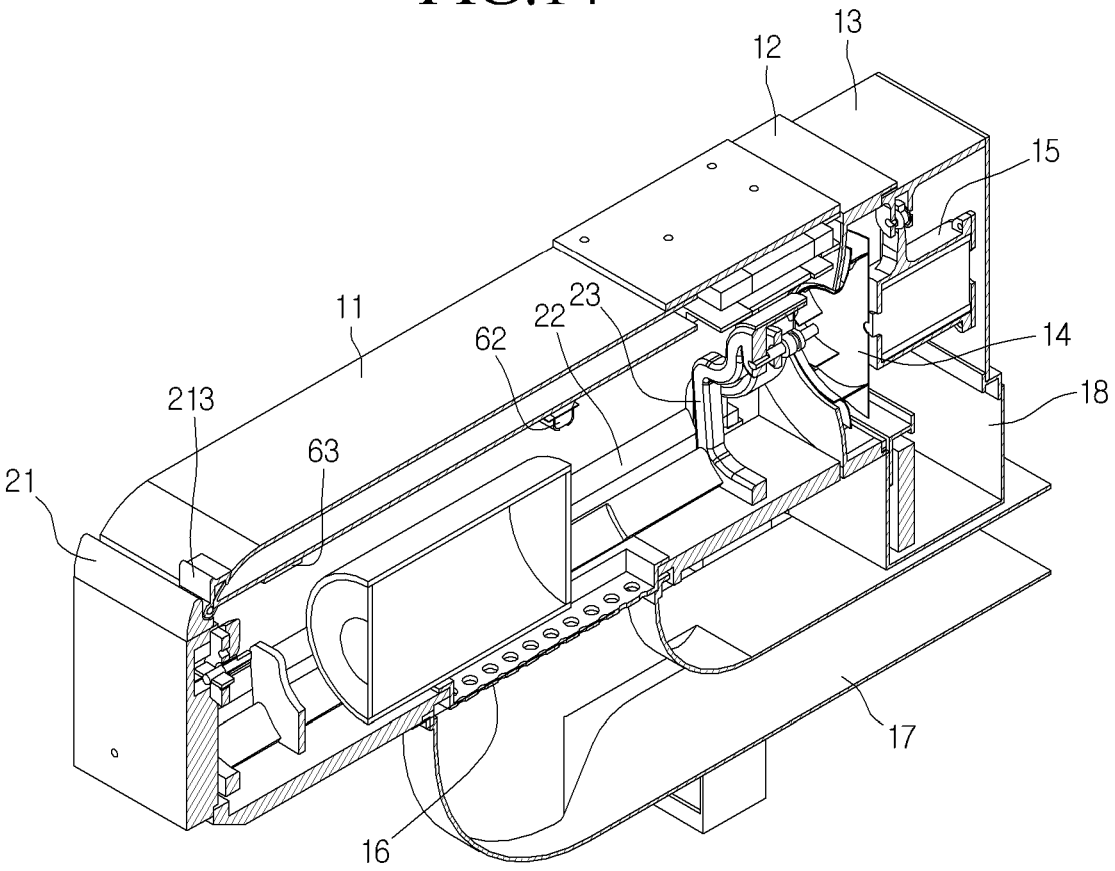
FIG. 14 is a cutaway perspective view illustrating an inner structure of a cooling apparatus including a temperature detection mechanism.

FIG. 14 illustrates an example inner structure of an example cooling apparatus including an example temperature detection mechanism.

Referring to FIG. 14, a non-contact type temperature sensor 62 may be provided to measure a temperature of a beverage container received in a cooling apparatus.

In detail, the non-contact type temperature sensor 62 may use a property in which objects emit thermal radiant energy and a temperature of the object is proportional to the thermal radiant energy. For example, the non-contact type temperature sensor 62 may include a pyroelectric infrared temperature sensor, a photonic temperature sensor, a thermopile, and an infrared photo diode.

In more detail, the non-contact type temperature sensor 62 may be disposed inside a case 11 of the cooling apparatus 10. For example, as shown in FIG. 14, the non-contact type temperature sensor may be disposed on a ceiling of the inside of the case 11. Also, like the contact type temperature sensor 61, the non-contact type temperature sensor may be provided in one or plurality. A temperature value detected by the non-contact type temperature sensor 62 may be transmitted into a control unit.

A reading unit 63 for reading bar code or RFID information provided on an outer surface of the beverage container may be disposed inside the case 11.

In detail, a bar code or RFID tag engraved on the beverage container may contain various information with respect to the beverage, such as a kind of beverage, a price, a manufactured date, shelf life, etc. Thus, the reading unit 63, such as a bar code reader or an RFID reader, which read bar code or RFID tag information may be disposed on the case 11. The reading unit 63 may read information related to the beverage put into the cooling apparatus 10, and then the control unit of the refrigerator may determine whether the quick cooling is possible and a time for the quick cooling to inform the determined data to the user.

The reading unit 63 is disposed at a position close to a front end of the case 11. Also, the beverage container is seated on an agitating member 23. Then, when a drawer 20 is pushed, the reading unit 63 may read information related to the beverage container.

Other than the method in which the above-described temperature sensors 61 and 62 detect the temperature of the beverage container, temperatures of a method in which cool air introduced into the case 11 and cool air discharged from the case 11 are detected to determine a quick cooling ending time may be used.

For example, temperature sensors may be respectively disposed on an outlet end of a suction duct 17, e.g., a cool air suction area through which the cool air is supplied into the case 11 and a rear surface of the case 11, e.g., a discharge area through which the cool air is discharged. When a difference between temperature values detected by the two temperature sensors is within a set range, it is determined that the quick cooling is completed.

When the quick cooling is completed, the current supply into the power generator and the fan motor 15 may be stopped.

Hereinafter, examples of informing users about information obtained from the reading part 63 and various information generated in the quick cooling process is described.

Figure 15:
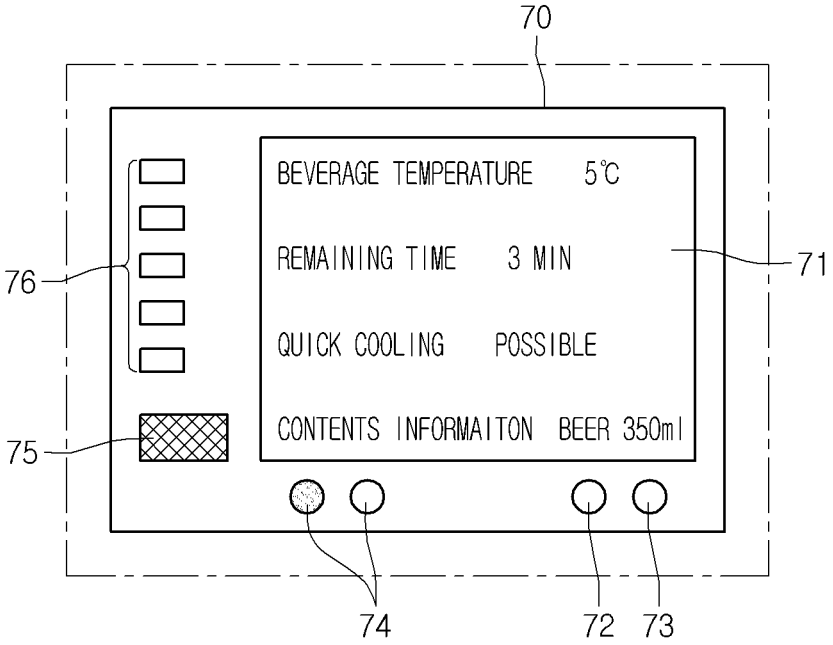
FIG. 15 is a view of an information display.

Referring to FIG. 15, a cooling apparatus may be disposed in a refrigerator 1 or freezer. Hereinafter, the refrigerator is described as an example.

In detail, a control panel 70 for displaying operation states of the refrigerator 1 and inputting commands with respect to various functions may be disposed on a door of the refrigerator 1. For example, in case of a refrigerator including a dispenser for dispensing water or ices, the control panel 70 including an input unit for inputting a water or ice dispensing command may be provided. Also, an input unit for adjusting an internal temperature of a refrigerating compartment or freezing compartment may be disposed on the control panel 70.

The control panel 70 may include a display unit 71 on which various information is displayed in character or drawing and various input units 76 disposed outside the display unit 71 and including dispensing buttons.

Also, the control panel 70 may include an image setting button 73 which changes or selects an image of the display unit 71 and a starting button 72 for performing a quick cooling mode.

Also, a speaker 75 for outputting a warning sound or alarm and a warning light 74 for informing a warning or alarm to a user may be disposed on a side of the control panel 70.

The display unit 71 may display the current temperature of a beverage container or beverage put into the cooling apparatus 10, a remaining time until the quick cooling is finished, whether a quick cooling function is performed, and information obtained from a bar code or RFID data placed on the beverage container.

In detail, when the beverage container is loaded on an agitating member 23 and the drawer 20 is pushed into the case 11, a temperature of the beverage container or beverage is detected by the temperature sensors 61 and 62. Then, the reading unit 63 reads information with respect to contents.

The information with respect to the contents may include a kind of beverage, an amount of beverage, a shelf life, a manufactured date, information of a manufacturer, etc. A portion of the information or the whole information may be displayed on the display unit 71.

Also, a sector (hereinafter, referred to as a beverage temperature display sector) for displaying a temperature of the beverage may display the current temperature at a time point at which the beverage container is inserted and a real-time temperature during the performance of the quick cooling mode. Also, the input unit through which the user selects a quick cooling temperature of the beverage may be provided. Thus, when the quick cooling temperature is selected through the input unit before the user pushes the starting button 72, the selected quick cooling temperature may be displayed on the beverage temperature display sector.

Also, a sector (hereinafter, referred to as a remaining time display sector) for displaying a remaining time may display the quick cooling time or remaining time obtained by performing a calculation in the control unit using the information of the contents within the beverage container and evaporating compartment temperature information of the refrigerator.

Also, a sector (hereinafter, referred to as a quick cooling mode yes/no display sector) for displaying whether the quick cooling is possible may display results of determining whether the quick cooling is possible according to conditions of the refrigerator or a kind of contents by the control unit of the refrigerator. Specific examples with respect to the above described operations are described with reference to the accompanying drawings.

When the user puts the beverage container into the cooling apparatus 10 and then pushes the starting button 72 to input the quick cooling command, whether the quick cooling is possible or impossible may be displayed on the display unit 71.

Also, when the quick cooling is possible, a blue light may be emitted from the warning light 74. On the other hand, when the quick cooling is impossible, a red light may be emitted. Thus, the user may confirm whether the quick cooling is possible. Also, information with respect to whether the quick cooling is possible may be audibly outputted (e.g., as a voice) through the speaker 75.

The voice information outputted through the speaker 75 may include the whole information or a portion of the information displayed on the display unit 71.

Hereinafter, what information is displayed on the display unit 71 according to cases in which the quick cooling is possible and impossible are described.

Figure 16:
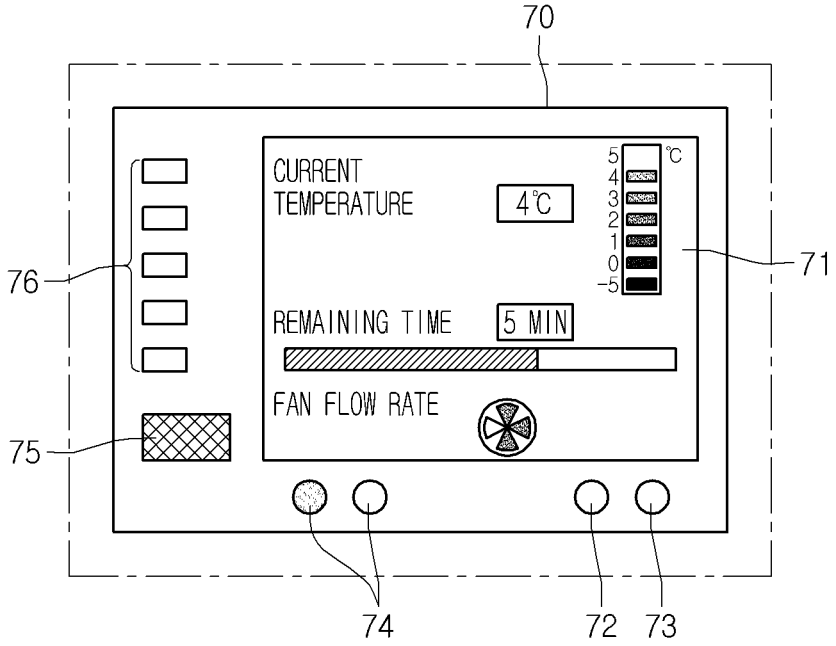
FIG. 16 is a view illustrating information displayed on a display when quick freezing is possible.

FIG. 16 illustrates example information displayed on a display when quick freezing is possible.

Referring to FIG. 16, the user puts the beverage container into the cooling apparatus 10, and then selects the quick cooling temperature. Then, the starting button 72 is pushed, and a term "possible" is displayed on the quick cooling yes/no display sector of the display unit 71. And simultaneously or selectively, the announcement "quick cooling mode is selected" is announced through the speaker 75. Alternatively, the announcement "quick cooling function performance is possible" may be announced. Also, a green light may be emitted from the warning light 74. When a screen of the display unit 71 may be automatically changed to display various information generated in a state where the quick cooling operation is performed.

When the screen of the display unit 71 is changed, the current temperature of the beverage container may be displayed on the display unit 71 using numbers or bar graphs having an equalizer form. The current temperature may include a beverage temperature just before the quick cooling starts and the current temperature in the process in which the quick cooling is performed. However, the current temperature may be displayed through various methods other than the numbers or bar graphs. Any method may be included in the scope of the present disclosure.

Also, a time remaining until the quick cooling is completed is displayed as numbers of second or minute units or a horizontal bar graph shape on the remaining time display sector. Alternatively, the remaining time may be displayed in the equalizer form, such as the current temperature display sector or in a sandglass shape. Also, the remaining time may be displayed through various methods other than the above-described methods.

Also, a flow rate of the cool air generated by an operation of the fan 14 in the quick cooling process may be displayed as numbers or drawing.

When the control unit determines that the beverage temperature detected by the temperature sensors 61 and 62 reaches a set cooling temperature, the operation of the fan 14 is stopped, and simultaneously, the power supply into power generators 191 and 192 is stopped.

Then, a screen of the display unit 71 is changed and character information, such as a term "quick cooling is completed" or drawing information, may be displayed on the entire screen or a portion of the screen.

And simultaneously or successively, sound information for informing the completion of the quick cooling through the speaker 75 may be outputted.

Alternatively, the warning light 74 may be turned on/off for a certain time to inform the completion of the quick cooling.

Figure 17:
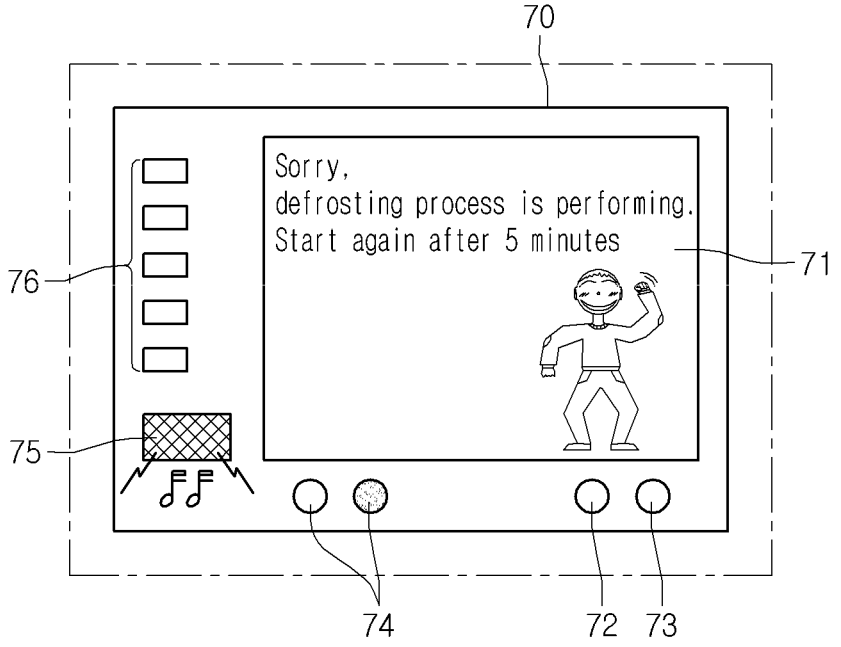
FIG. 17 is a view illustrating information displayed on a display when quick freezing is impossible.

FIG. 17 illustrates example information displayed on a display when quick freezing is possible.

Referring to FIG. 17, in case where the quick cooling function is impossible, such as when the fan 14 is not operated due to its breakdown, when the quick cooling function is not performed because a defrosting process is performed, or when it is determined that the quick cooling function is impossible because the contents is not adequate for the quick cooling, information for informing that the quick cooling function is impossible may be disposed on the screen of the display unit 71.

For example, as shown in FIG. 17, the screen of the display unit 71 is changed, and then, character information, such as a term "Sorry, quick cooling function is impossible. Start again after 5 minutes" or a term. "Sorry, defrosting process is performing. Start again after 5 minutes", or the drawing or avatar information may be displayed on the entire screen or a portion of the screen.

And simultaneously or selectively, sound information for informing that the quick cooling function is impossible may be outputted through the speaker 75. Also, a red light may be turned on or turned on/off several times through the warning light 74 to allow the user to inform that the quick cooling function is impossible.

According to the above-described configuration, the quick cooling time may be calculated according to a temperature of the beverage container detected by the temperature sensors 61 and 62. Then, the calculated results may be displayed on the display unit 71. The user may confirm the quick cooling time to conduct other business.

Also, since information with respect to the quick cooling, e.g., information with respect to whether the quick cooling is possible is displayed on the display unit 71, the user may immediately confirm whether the quick cooling is possible. Also, when the quick cooling is impossible, its cause may be grasped and quickly treated to improve convenience of use.

Figure 18:
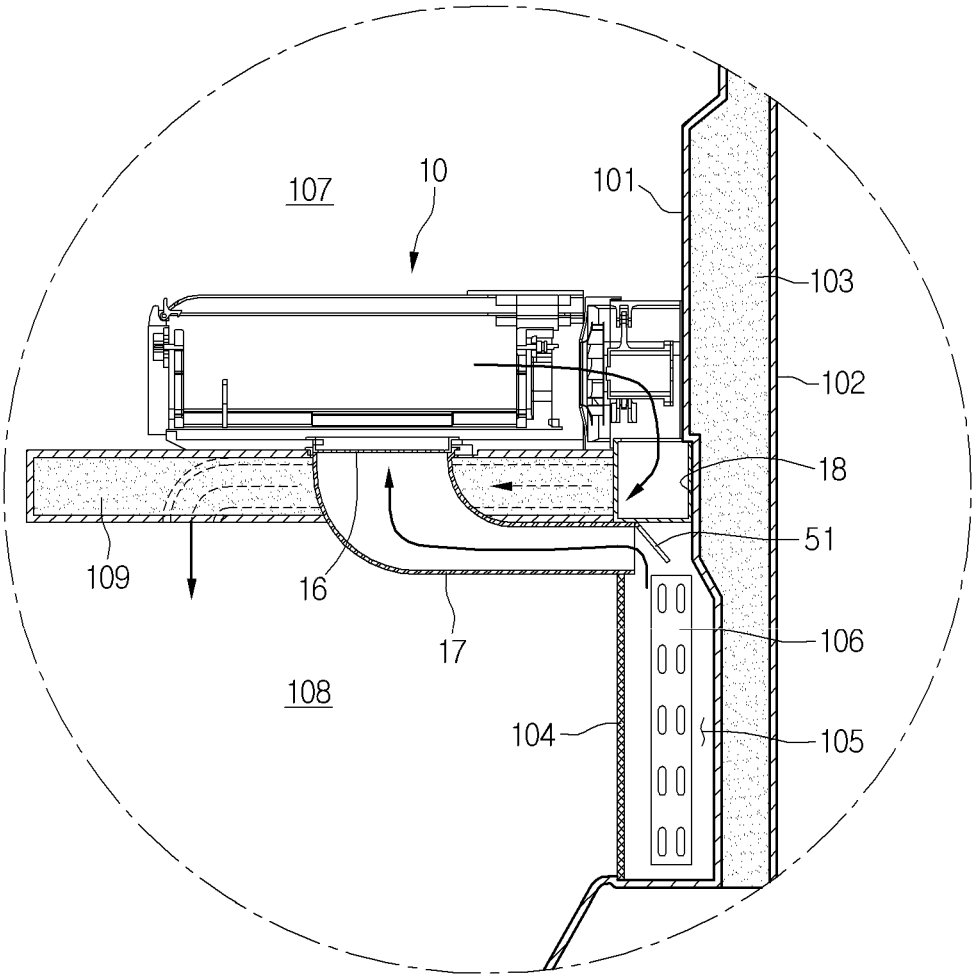
FIG. 18 is a sectional view illustrating a structure of a cool air passage of a cooling apparatus.

FIG. 18 illustrates a structure of an example cool air passage of an example cooling apparatus.

Referring to FIG. 18, a cool air passage of a cooling apparatus 10 is similar to those described above except cool air passing through a case 11 of a chilling compartment is discharged toward a front side of a freezing compartment.

Figure 19:
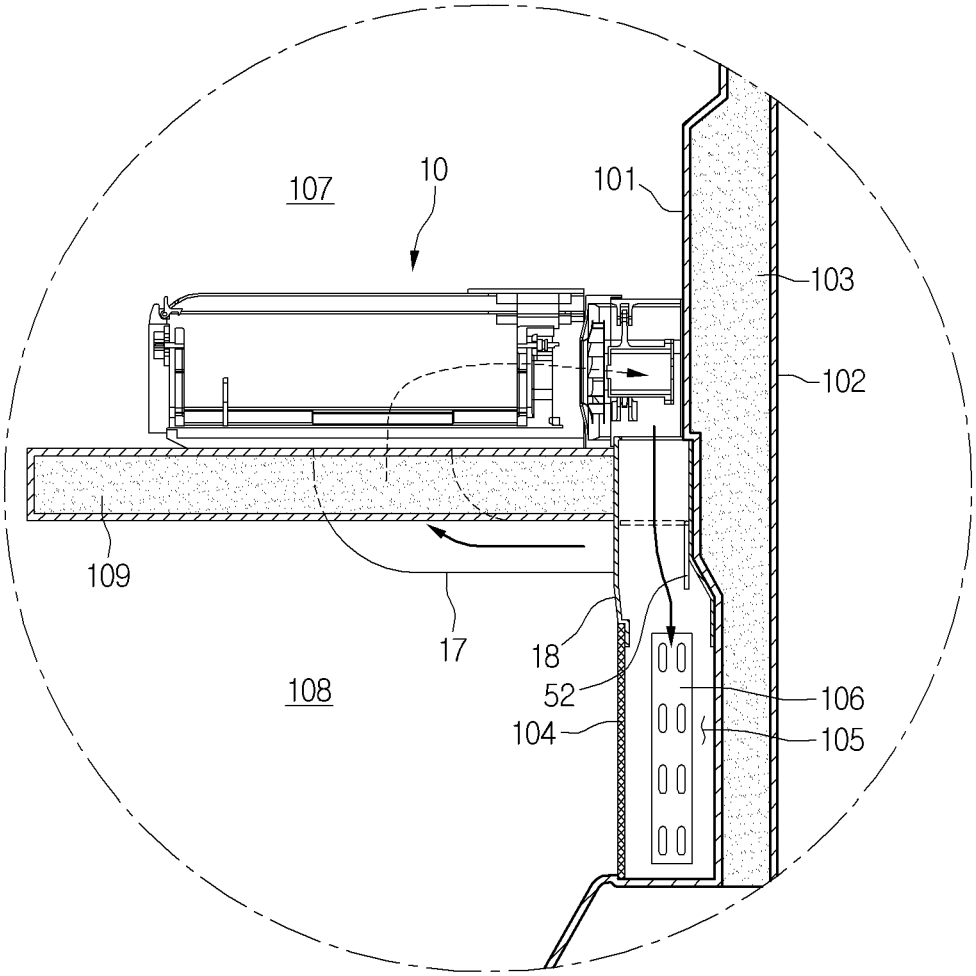
FIG. 19 is a sectional view illustrating a structure of a cool air passage of a cooling apparatus.

Here, an inner structure of the cooling apparatus 10 of FIGS. 18 and 19 is different from that of the cooling apparatus of FIG. 3. However, this difference does not affect the idea with respect to a cool air passage. That is, the cooling apparatus of FIG. 3 may be replaced with those of FIGS. 18 and 19.

In detail, in the cooling apparatus 10, an inlet of a return duct 18 may communicate with an opening defined in a bottom of a motor housing 13. Then, the inlet extends toward a front side of the freezing compartment 108 in a state where it is buried in a partition wall 109. An outlet of the return duct 18 may be disposed on an under surface of the partition wall 109, e.g., a ceiling surface of the freezing compartment 108.

According to a structure of the cool air passage, the cool air generated in an evaporating compartment 105 is introduced into the case 11 according to a suction duct 17. Then, the cool air introduced into the case 11 may contact against a beverage container to heat-exchange with contents within the container. Then, the cool air is moved to a rear side of the case 11 to successively pass through a fan housing 12 and a motor housing 13. The cool air passing through the motor housing 13 is moved to a front side of the partition wall 109 along the return duct 18. Then, the cool air is discharged into the freezing compartment 108 through the outlet of the return duct 18.

Here, the outlet of the return duct 18 is disposed close to a front end of the freezing compartment 108. That is, the outlet of the return duct 18 is disposed close to a freezing compartment door. The cool air is vertically discharged downward through the outlet of the return duct 18. Thus, the cool air discharged through the outlet of the return duct 18 may perform a function of an air curtain. That is, when the freezing compartment door is opened, a phenomenon in which an external air is introduced into the freezing compartment 108 may be reduced somewhat by the cool air discharged from the return duct 18. Thus, an increase of a load of the freezing compartment due to the opening of the freezing compartment may be reduced. To smoothly perform the air curtain function, the outlet of the return duct 18 has a left and right width corresponding to a width of the freezing compartment 108 and a relatively small front and rear width. Thus, a flow rate and a discharge amount of the cool air may be increased to reduce external air from being introduced through the front surface of the freezing compartment 108.

Also, the return duct 18 may be buried in the partition wall 109, but is not limited thereto. In detail, like the installation structure of the suction duct 17, the whole return duct 18 or a portion of the return duct 18 may be exposed to the freezing compartment 108.

In detail, when the quick cooling function is not performed, cool air within the evaporating compartment should be stopped from being introduced into the case 11. Thus, when the quick cooling function is not performed, the damper 51 may block a suction passage of the suction duct 17.

The damper 51 may be applied to the above examples using similar techniques. A damper also may be additionally or alternatively applied to the return duct 18 (e.g., applied to an outlet of the return duct 18). The damper may open the return duct 18 when the cooling apparatus operates and close the return duct 18 when the cooling apparatus is off.

FIG. 19 illustrates an example structure of an example cool air passage of an example cooling apparatus.

Referring to FIG. 19, the example shown is different from the example shown in FIG. 18 in that a return duct 18 communicates with an evaporating compartment. However, other parts are similar to those described above.

In detail, since the return duct 18 extends to the evaporating compartment, cool air for quick cooling may be circulated into the evaporating compartment and the case 11 of the cooling apparatus 10.

Also, in addition to the damper 51 for selectively covering the suction duct 17, a damper 52 for selectively covering the return duct 18 may be additionally provided. In detail, when the quick cooling function is not performed, the cool air within the evaporating compartment 105 may be introduced into the case 11 through the suction duct 17 as well as the return duct 18. Thus, the damper 52 may be disposed in the inside or on an outlet end of the suction duct 17 as well as the return duct 18.

As described above, since the return duct 18 communicates with the evaporating compartment 105, it may reduce the likelihood of (e.g., prevent) the freezing compartment 108 from being overcooled due to the cool air discharged from the return duct 18 in the quick cooling process.

Figure 20:
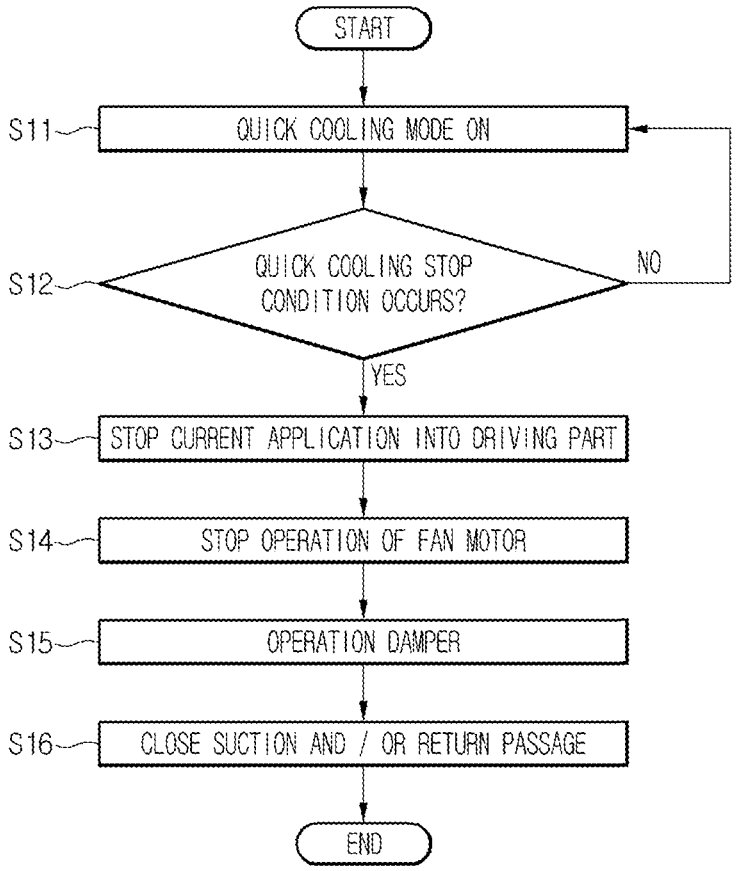
FIG. 20 is a flowchart illustrating a process of controlling a quick cooling apparatus.

FIG. 20 illustrates an example process of controlling a quick cooling apparatus.

Referring to FIG. 20, when quick cooling stop conditions, such as a condition in which the drawer 20 is opened occurs, a control method for stopping the quick cooling function is described below.

In detail, the beverage container is loaded on an agitating member 23 by a user's selection. After the drawer 20 is closed, when a quick cooling command is inputted, a quick cooling function is performed (S11).

Particularly, to operate the agitating member 23, a power is applied to a driving motor 191 of a power generator 19 to supply a current. Thus, since the power transmission unit 192 is operated, the agitating member 23 is swung in left and right directions. Then, the current is supplied into a fan motor 15 for operating a fan 14 to generate a suction force while the fan 14 is rotated at a high speed.

When the quick cooling function is performed, whether the quick cooling stop condition occurs is detected in real-time (S12). In detail, the quick cooling stop condition may include a case in which a user manipulates a control panel disposed on a refrigerator door to directly input a quick cooling stop command and a case in which the user withdraws the drawer 20 when the quick cooling function is performed.

In detail, the door of the refrigerator including the cooling apparatus 10 includes a display for displaying an operation state of the refrigerator and an operation state of the cooling apparatus 10 and a control panel including an input unit for inputting commands with respect to operations of the refrigerator and the cooling apparatus 10. The user may input commands with respect to an operation of the cooling apparatus 10 disposed on the control panel. For example, the control panel may include a quick cooling mode select button, a quick cooling mode start button, and a quick cooling mode stop button. The user may push the buttons to input commands. Specifically, when the user pushes the quick cooling mode stop button, a stop command is transmitted into the control unit. Then, the control unit may determine that a quick cooling mode stop condition occurs according to the transmitted command.

For another example of the quick cooling mode stop condition, in a method for detecting whether the drawer 20 is withdrawn, a detection unit equal or similar to a door open detection switch disposed on a front surface of a refrigerator body may be used. That is, a drawer withdrawal detection switch may be disposed on a front surface of the case 11 to detect whether a door 21 of the drawer 20 is separated from the case 11. The detection switch may be immediately turned on when the drawer 20 is withdrawn. Then, an ON signal may be transmitted into the control unit.

Alternatively, the detection switch may be disposed on a latch groove 116 defined the case 11. That is, in a state where a door latch 213 is inserted in the latch groove 116, the ON signal is not generated from the detection switch. For example, the ON signal may occur just as the door latch 213 is separated from the latch groove 116. In addition, whether the drawer 20 is withdrawn may be detected through various methods. When an occurrence of a quick cooling mode stop condition is detected, the control unit stops power supply into a driving part, e.g., the driving motor 191 (S13). Here, even just before the power supply into the driving motor 191 is stopped, when the drawer 20 is withdrawn to allow the driven part 192 to disconnect from the driving part 191, a swing motion of the agitating member 23 may be automatically stopped. However, even though an operation of the agitating member 23 is stopped, since the current is continuously supplied into the driving motor 191, it is unnecessary to immediately stop the power supply through the control unit if the drawer 20 is withdrawn.

Also, the current application into the driving motor 191 is stopped, and simultaneously or after a predetermined time elapses, the power supply into the fan motor 15 may be interrupted to stop an operation of the fan 14 (S14).

Also, a damper may be disposed inside the suction duct 17, on a suction end of the suction duct 17, inside the return duct 18, and/or on an end of the return duct 18. Thus, when the quick cooling mode is not performed, the damper may block an inlet end of the suction duct 17 and/or an end of the return duct 18.

Thus, transfer of cool air within the evaporating compartment 105 into the case 11 may be reduced (e.g., prevented) reduced and/or transfer of warm air from the case 11 into the freezing or evaporating compartment may be reduced. That is, since the suction and/or return passage is blocked, it may reduce (e.g., prevent) cool air from inappropriately leaking.

Thus, when the quick cooling stop condition occurs, the damper may be operated (S15), and the suction and/or return passage connected to the chilling compartment including the case 11 may be closed by the operation of the damper (S16).

As described above, while the quick cooling is performed, when the quick cooling stop condition is detected by inputting the user's command or withdrawing the drawer 20, the method stops the power from being applied to the power generator 19 and the fan motor 15. Therefore, unnecessary power consumption may be reduced, and it may reduce (e.g., prevent) the cool air from leaking to the outside of the cooling apparatus 10.

Here, the process in which the power supply into the driving part, e.g., the driving motor 191, is stopped and the process in which the power supply into the fan motor 15 is stopped at the same time. Alternatively, any one process may be performed in advance of the other process. That is, the power supply into the fan motor 15 may be stopped, and then, the power supply into the driving part 191 may be stopped. On the other hand, the power supply into the driving part 191 may be stopped, and then, the power supply into the fan motor 15 may be stopped. Alternatively, the power supply into the driving part 191 and the fan motor 15 may be stopped at the same time.

Figure 21:
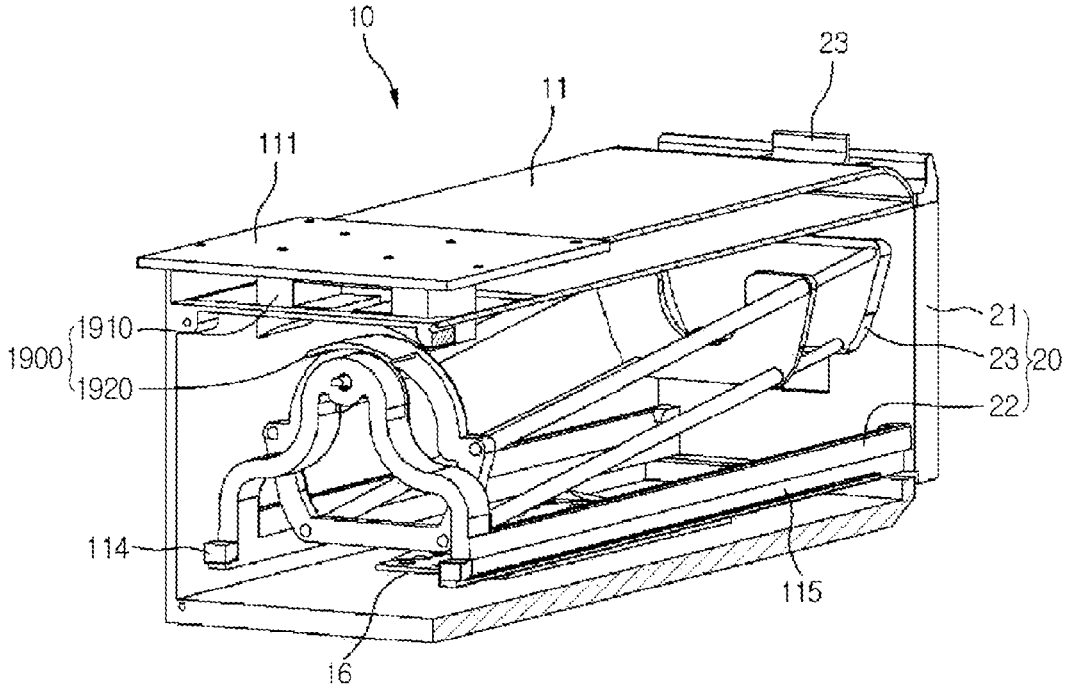
FIG. 21 is a partially cutaway perspective view illustrating a case of a cooling apparatus.
Figure 22:
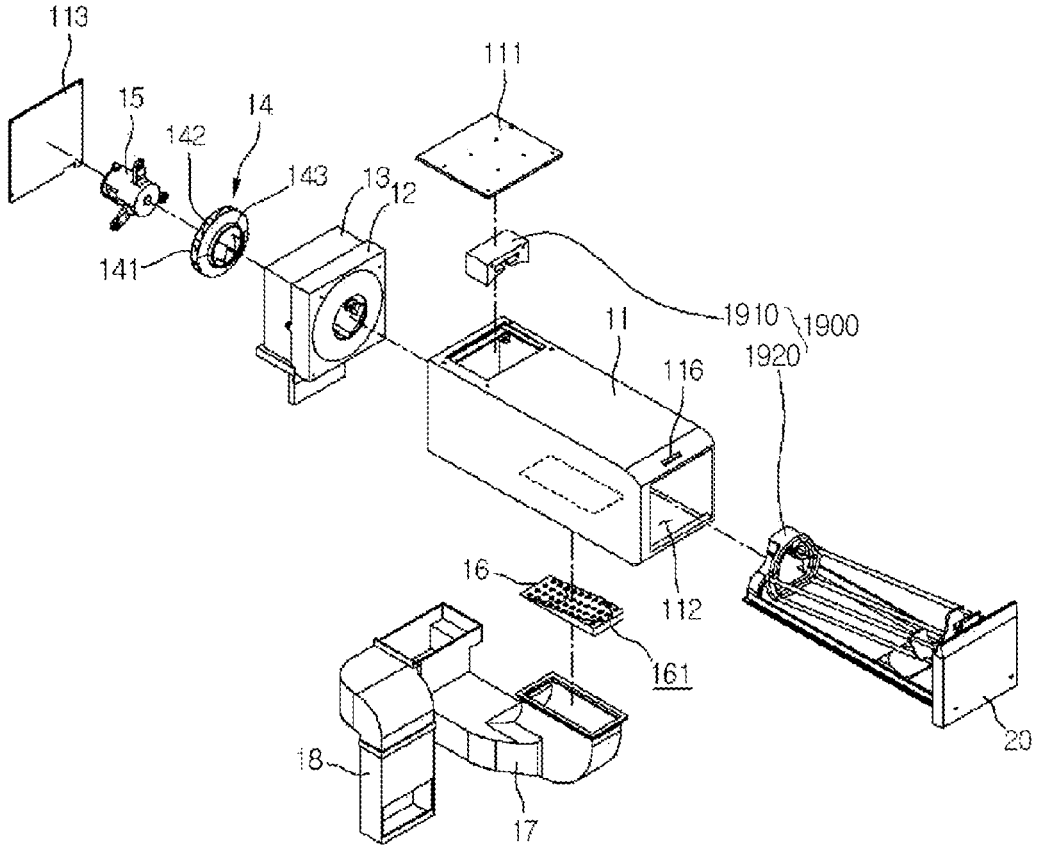
FIG. 22 is an exploded perspective view of the cooling apparatus.
Figure 23:
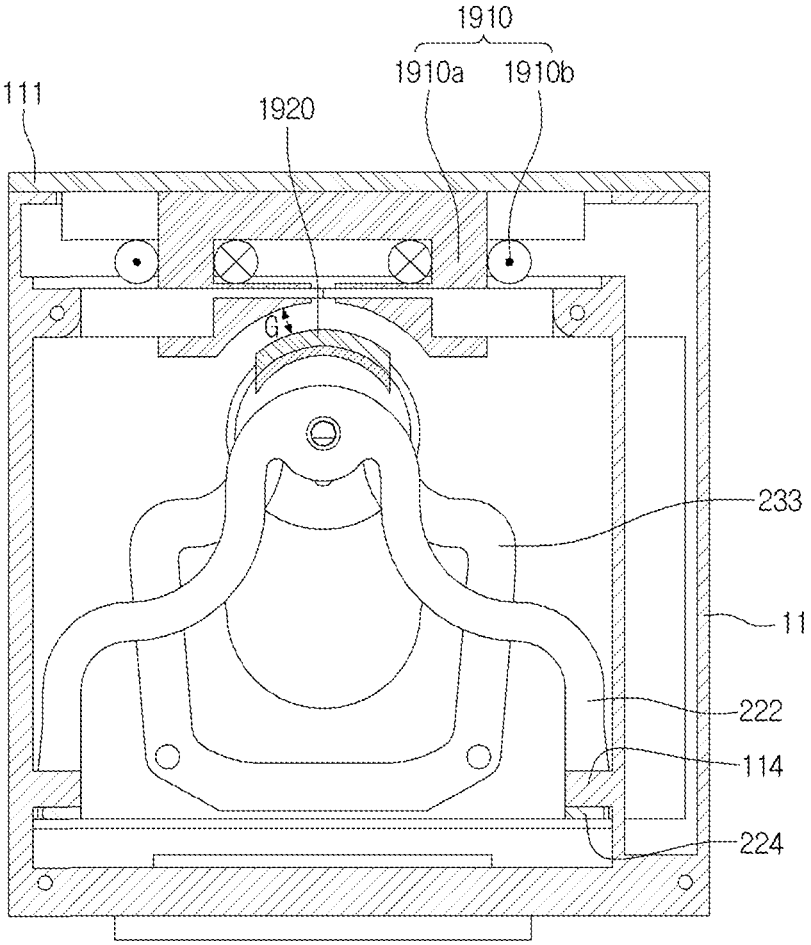
FIG. 23 is a sectional view of an electromagnetic power generator.

FIG. 21 illustrates an example case of an example cooling apparatus. FIG. 22 is an exploded perspective view of the example cooling apparatus. FIG. 23 illustrates a cross-section of the example cooling apparatus.

Referring to FIGS. 21 to 23, a cooling apparatus 10 has the same structure as the cooling apparatus 10 described above, except for the structure of the power generator that causes the agitating member 23 to swing. Description with respect to similar structures as those of the above examples is not repeated.

As shown in FIGS. 21 to 23, the cooling apparatus 10 uses an electro-magnetic power generator 1900. The power generator 1900 may include a driving part 1910 and a driven part 1920. The driving part 1910 is fixed to the case 11, and the driven part 1920 is fixed to the drawer 20. The driving part 1910 and the driven part 1920 may cause the agitating member 23 to swing and, thus, agitate a container being held by the agitating member 23 in a similar manner as the driving motor 191 and power transmission unit 192 described above, except that the driving part 1910 and the driven part 1920 use magnetic forces to generate force that causes movement of the agitating member 23.

In detail, the driving part 1910 may include a core 1910*a* fixed to an under surface of the support plate 111 of the case 11 and a coil 1910*b* wound on the core 1910*a*. Two columns for winding the coil 1910*b* are disposed on the core 1910*a*. As shown in FIG. 23, the coil 1910*b* is wound at positions facing each other and spaced from each other. That is, the coil 1910*b* is wound on each of left and right sides of the core 1910*a*. When electricity flows into the coil 1910*b*, the driving part 1910 becomes an electromagnet to form a magnetic flux in an empty space inside the core 1910*a*. Also, the coils 1910*b* are wound in directions symmetric to each other. For example, the left coil 1910*b* may be wound in a clockwise direction, and the right coil 1910*b* may be wound in a counterclockwise direction. Thus, when electricity flows into the left coil 1910*b* and when electricity flows into the right coil 1910*b*, the magnetic flux within the core 1910*a* may be formed in directions opposite to each other. That is, an attractive force is generated at one side of the core 1910*a*, and a repulsive force is generated at the other side.

Also, the driven part 1920 may be a permanent magnet. Thus, the driven part 1920 may be pulled in a left or right direction (e.g., swing back and forth) by the magnetic flux generated in the core 1910*a*. The agitating member 23 is reciprocatively rotated in the left and right directions by the attractive and repulsive forces generated between the electromagnet and the permanent magnet. For example, the attractive force may be generated at the left side of the core due to the electricity flowing into the left coil 1910*b*, and thus the repulsive force may be generated at the right side of the core 1910*a*. Thus, the driven part 1920 is pulled into the left side of the core 1910*a*. As a result, the agitating member 23 is rotated in the counter clockwise direction. Also, when the flow direction of electricity is changed, the attractive and repulsive forces are exchanged with each other. Thus, the agitating member 23 is rotated in the clockwise direction.

Here, a method in which electricity flows into the coil 1910*b* may include two methods, e.g., DC and AC current methods. When the DC current flows into the coil 1910*b*, positive and negative currents are repeatedly varied through its control to allow the magnetic flux generated at the left and right sides to be continuously and repeatedly changed. Also, when the AC current flows, the magnetic flux of the core 1910*a* is continuously and repeatedly changed into N and S polarities due to characteristics of the AC current.

The driving part 1910 and the driven part 1920 may be changed in position. That is, the driving part 1910 may be disposed on the drawer 20, and the driven part 1920 may be fixed to the case 11. In this case, a structure may be provided in which the current supply into the driving part 1910 is stopped just as the drawer 20 is taken off the case 11. A terminal part and a socket part may be provided to selectively supply the current into the driving part 1910 according to whether the drawer 20 is taken in or out.

An air gap G may be defined between the driving part 1910 and the driven part 1920 so that they do not contact each other. When the air gap G is very small, it may be difficult to manage a clearance. That is, when the drawer 20 is inserted into the case 11, the driving part 1910 may contact the driven part 1920 due to the very small air gap G. On the other hand, when the air gap G is very large, a large permanent magnet may be required. Also, an amount of current supplied into the driving part 1910 may be increased. Thus, it is desirable to set an adequate gap between the driving part 1910 and the driven part 1920. The air gap G may be set such that, when the drawer 20 is completely inserted into the case 11, the driving part 1910 and the driven part 1920 align and are spaced apart by a gap that allows the magnetic force of the driving part 1910 to interact with the driven part 1920.

Although the example shown in FIGS. 21 to 23 uses the electro-magnetic power generator 1900, the other characteristics and attributes of the cooling apparatus described throughout this disclosure may be applied in a similar manner to the examples described above in which a motor is used in the power generator. Accordingly, the example shown in FIGS. 21 to 23 may use any of the control methods and additional features described throughout this disclosure.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A refrigerator comprising:

a refrigerator body;

a refrigerating compartment and a freezing compartment being configured to maintain operating temperatures that differ, with the freezing compartment having an operating temperature that is lower than an operating temperature of the refrigerating compartment; and a cooling apparatus that is positioned in the refrigerating compartment and that is configured to cool liquid held by a container positioned therein, the cooling apparatus including:

a case mounted on an inner wall defining the refrigerating compartment, the case being defined by a front surface, a rear surface, side surfaces, an upper surface, and a lower surface having an air inlet;

a rear frame extending upward and placed a predetermined distance away from the front surface of the case;

an agitating member that is positioned within the case, that receives the container, and that includes a swing axis at a predetermined position thereof, the agitating member comprising:

a front support that defines a front end of the agitating member and that is rotatably connected to the front surface of the case, a rear support that defines a rear end of the agitating member and that is rotatably connected to the rear frame, and a holding part that connects the front support and the rear support and that is configured to receive the container, and a power generating member configured to swing the agitating member over an angle, the power generating member including:

a driving motor generating a rotation force; and a power transmission unit that connects the driving motor and the agitating member and that is configured to swing the agitating member, wherein the swing axis of the agitating member is substantially horizontal, and passes through rotation centers of the front and rear supports, and wherein a rotation center of the rear support of the agitating member is located at an upper end of the rear support via a rotation shaft, and a rotation center of the front support of the agitating member is disposed at a center of the front support, thereby defining a swing trace of a rear end of the agitating member to be greater than a swing trace of a front end of the agitating member.

2. The refrigerator of claim 1, wherein a distance from the swing axis of the rear support of the agitating member to a lower end of the rear support is longer than a distance from the swing axis of the front support of the agitating member to a lower end of the front support, thereby causing more agitation at a rear end of the container than a front end of the container.

3. The refrigerator of claim 1, wherein the power transmission unit includes:

a rotation member eccentrically connected to a rotation axis of the driving motor;

a rod eccentrically coupled to the rotation member and configured to move in a vertical direction; and a connection member connecting a lower end of the rod to the rotation shaft that extends backwardly from the rear support.

4. The refrigerator of claim 1, further comprising a suction grille that is disposed in the air inlet and that is configured to supply cool air to the container, the suction grille having a plurality of cool air through holes to discharge the cool air to an outer surface of the container, wherein the suction grille has a top surface inclined upwardly from a rear end thereof to a front end thereof, such that the cool air discharged from the plurality of cool air through holes contact against an outer surface of the container at a substantially right angle with maximum velocity.

5. The refrigerator of claim 1, wherein the front surface of the case is a door which is separable from the case.

6. The refrigerator of claim 5, further comprising a side frame connecting the door and the rear frame, the side frame configured to be slidably placed inside the case such that the agitating member slides in or out of the case, wherein the side frame includes:

a first side frame connecting a first lower end of the rear frame and the door; and a second side frame connecting a second lower end of the rear frame and the door.

7. The refrigerator of claim 5, further comprising:

a door latch rotatably mounted on an upper end of the door; and a latch groove recessed in a front end of the case such that the door latch is hooked to the latch groove.

8. The refrigerator of claim 6, further comprising:

a pair of hook protrusions protruding from both side inner surfaces of the case; and a pair of hook ends protruding backwardly from the first and second lower ends of the rear frame, wherein, when the door is completely closed, the hook ends are respectively inserted in gaps formed between under surfaces of the pair of hook protrusions and a lower surface of the case to be closely attached to under surfaces of the hook protrusions.

9. The refrigerator of claim 1, wherein the holding part includes a plurality of holder shafts extending in parallel with each other, wherein front ends of the holder shafts are higher than rear ends of the holder shafts such that a front end of the container placed on the agitating member is higher than a rear end of the container.

10. The refrigerator according to claim 1, further comprising;

an evaporating compartment behind the freezing compartment;

a suction fan assembly mounted on the rear surface of the case;

a suction duct of which an outlet is connected to the air inlet of the case; and a return duct connected to the suction fan assembly, wherein air from the evaporating compartment is introduced to the case through the air inlet, discharged to an outer surface of the container to exchange heat with the liquid in the container, allowed to flow towards the rear surface of the case, and discharged through the return duct.

* * * * *